US006700363B2

(12) United States Patent
Tachimori

(10) Patent No.: US 6,700,363 B2
(45) Date of Patent: Mar. 2, 2004

(54) REFERENCE VOLTAGE GENERATOR

(75) Inventor: Hiroshi Tachimori, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/241,721

(22) Filed: Sep. 12, 2002

(65) Prior Publication Data

US 2003/0052661 A1 Mar. 20, 2003

(30) Foreign Application Priority Data

Sep. 14, 2001 (JP) ..... P2001-280064

(51) Int. Cl.[7] ..... G05F 3/16
(52) U.S. Cl. ..... 323/313
(58) Field of Search ..... 323/312, 313, 323/314; 327/530, 538, 542

(56) References Cited

U.S. PATENT DOCUMENTS 4,375,596 A * 3/1983 Hoshi ..... 327/541
5,315,230 A * 5/1994 Cordoba et al. ..... 323/313
5,532,578 A * 7/1996 Lee ..... 323/313
5,783,935 A * 7/1998 Kyung ..... 323/313
6,005,379 A * 12/1999 Wong et al. ..... 323/313
6,040,735 A * 3/2000 Park et al. ..... 327/541
6,265,858 B1 * 7/2001 Park ..... 323/313
6,528,978 B2 * 3/2003 Lim ..... 323/313
6,548,994 B2 * 4/2003 Jang ..... 323/313

FOREIGN PATENT DOCUMENTS

JP 56-108258 8/1981
JP 10-63361 3/1998
JP 2000-56846 2/2000

* cited by examiner

*Primary Examiner*—Adolf D. Berhane
(74) *Attorney, Agent, or Firm*—Rader, Fishman & Grauer PLLC; Ronald P. Kananen

(57) ABSTRACT

The present invention provides a reference voltage generator capable of operating stably at a low power source voltage, suppressing the increase of a current consumption and providing a stable reference voltage at a high power source voltage, and reducing a layout area. A pMOS transistor, a resistance element, an nMOS transistor, a resistance element and an nMOS transistor are connected in series between a supply line of a power source voltage and a common potential line. The transistors are low threshold voltage transistors, all the transistors are rendered conductive during operation, in the low range of the power source voltage, transistor currents are determined by ON resistances of the transistors, while in the high range of the power source voltage, the transistor currents are determined by the resistance values of the resistance elements, hence it is possible to provide a stable reference voltage at the low power source voltage while suppressing the rapid increase of the current consumption at the high power source voltage.

19 Claims, 23 Drawing Sheets

REFERENCE VOLTAGE GENERATOR

BACKGROUND OF THE INVENTION

1. Field of the Invention

The present invention relates to a reference voltage generator, which provides a reference voltage, for example, an intermediate voltage of a power source voltage as a reference voltage.

2. Description of the Related Art

With lowering of power source voltage of semiconductor integrated circuits proceeding year by year, semiconductor integrated circuits used for portable information terminal devices are required to operate at a low power source voltage of for example 1.5V or less. On the other hand, as for non-portable/fixed machine, operating at a power source voltage of approximately 3.3V is desired, because of the easiness of parts at a low power source voltage inside the devices to communicate through an interface with other IC's.

In recent years, low voltage differential signaling (LVDS) was developed as one of the high-speed digital signal transmission technologies. Although drivers and receivers used for LVDS are achieved with analogue circuits, functionally they are operating as digital circuits for processing digital signals. In such analogue circuits, when built in semiconductor integrated circuits, it is desirable to operate properly as the other digital circuits, for example, even if the operation speed becomes slower when the power source voltage is different by two times and more.

It is necessary to provide an intermediate voltage of the power source voltage as a reference voltage to transfer a digital signal by using LVDS. Up until now, various configuration examples of reference voltage generators for generating the intermediate voltage of the power source voltage have been proposed. For example, reference voltage generators are disclosed in each of the following patent document "JP. Pat. Publication No. S56-108258", "JP. Pat. Publication No. H10-63361" and "JP. Pat. Publication No. 2000-56846".

FIGS. 22 to 24 show circuit examples of the reference voltage generator disclosed in the above patent document.

FIG. 22 shows an example of the configuration of a reference voltage generator disclosed in "JP. Pat. Publication No. S56-108258". As illustrated in FIG. 22, in this example, a reference voltage generator is constituted by diodes formed by MOS transistors connected in series between the supply line of the power source voltage $V_{dd}$ and the common electric potential $V_{SS}$.

FIG. 23 shows another example of the configuration of a reference voltage generator disclosed in "JP. Pat. Publication No. H10-63361". As illustrated in FIG. 23, in this reference voltage generator, diodes, diodes constituted by MOS transistors, and voltage dividing resisters are provided, and the intermediate voltage $V_{ref1}$ of the power source voltage $V_{dd}$ is generated by the voltage dividing circuit constituted by these circuit elements. Furthermore, a high reference voltage $V_{ref2}$, which is higher in level than the intermediate voltage $V_{ref1}$, is generated by the voltage dividing resisters.

Furthermore, FIG. 24 shows another example of the configuration of a reference voltage generator disclosed in "JP. Pat. Publication No. 2000-56846". As illustrated in FIG. 24, in this example, diodes constituted by MOS transistors are connected in parallel, to constitute a voltage dividing circuit, whereby the intermediate voltage $V_{ref}$ of the power source voltage $V_{dd}$ is generated by the voltage dividing circuit.

FIG. 25 shows a most general reference voltage generator constituted by voltage dividing resisters. Generally, in a semiconductor integrated circuit manufactured by a process without high resistance that may be microscopically processed, a very large layout area is necessary for a $V_{dd}/2$ voltage generator constituted by resisters. On the other hand, a layout area which is only several tenths of that of the case constituted by resisters is sufficient to an intermediate voltage generator using diodes constituted by MOS transistors.

However, in the reference voltage generator using diodes constituted of the MOS transistors described above, as a power source voltage for operation, a power source voltage $V_{dd}$ ($V_{dd} \geqq 2V_{th}$) that is twice of the threshold voltage $V_{th}$ of the MOS transistors or higher is necessary.

Therefore, it is able to operate without any problem at a power source voltage that is equal to 1.5V or higher, near 3.3V. However, when there is a demand to operate at a low power source voltage of, for example, a low power source voltage equal to or less than 1.5V, the minimum value of the power source voltage $V_{dd}$ will be $V_{dd} \approx 2V_{th}$ in a poor condition such as a low temperature, and when the driving current becomes equal to or lower than several hundreds of nA, it suffers from a disadvantage that a stable reference voltage can not be supplied any more. Inversely, when the circuit is designed to operate at a low power source voltage that is 1.5V or higher, while maintaining a driving current of several $\mu$A, a current of several mA passes through the MOS diodes at the power source voltage near 3.3V, so there is a disadvantage that the power consumption grows very large.

As shown in FIG. 25, in the reference voltage generator constituted by the resistors, although there is no problem of the driving current increasing when the power source voltage is near 3.3V, there is a disadvantage that the layout area becomes large to form resistance elements on the substrate.

SUMMARY OF THE INVENTION

The present invention was made in consideration with the circumstance and an object thereof is to provide a reference voltage generator capable of stable operating at a low power source voltage, and supplying a stable reference voltage while suppressing the increase of the power consumption at a high power source voltage, and capable of suppressing the increase in the layout area in minimum.

To attain the above objects, according to the present invention, there is provided a reference voltage generator comprising a first MOS transistor and a first resistance element connected in series between a first power supply line and an output terminal; a second MOS transistor having a same conductivity type as the first MOS transistor, a second resistance element, and a third MOS transistor having a different conductivity type from the first MOS transistor connected in series between the output terminal and a second power supply line, wherein the third MOS transistor has a first threshold voltage, and the first and second MOS transistors have a second threshold voltage which has a lower absolute value than that of the first threshold voltage, and an intermediate voltage of the first power supply and the second power supply line is output from the output terminal.

Preferably, in the present invention, a source and a channel forming region of the first MOS transistor are connected to the first power supply line, a source and a channel forming region of the second MOS transistor are connected to the output terminal, and a source and a channel forming region of the third MOS transistor are connected to the second power supply line.

Preferably, in the present invention, a gate of the first MOS transistor is connected to the output terminal, and a voltage of the first power supply line is supplied thereto during standby, a voltage of the second power supply line is supplied to a gate of the second MOS transistor during operation, and the voltage of the first power supply line is supplied thereto during standby, and the voltage of the first power supply line is supplied to a gate of the third MOS transistor during operation, and the voltage of the second power supply line is supplied thereto during standby.

Preferably, in the present invention, a voltage of the output terminal is supplied to a gate of the first MOS transistor during operation and the voltage of the second power supply line is supplied thereto during standby, the voltage of the second power supply line is supplied to a gate of the second MOS transistor during operation and the voltage of the first power supply line is supplied thereto during standby, and the voltage of the first power supply line is supplied to a gate of the third MOS transistor during operation and the voltage of the second power supply line is supplied thereto during standby.

Preferably, in the present invention, the gate of the first MOS transistor is connected to the drain thereof, the drain voltage of the second MOS transistor is supplied to the gate of the second MOS transistor during operation and the voltage of the first power supply line is supplied thereto during standby, the voltage of the first power supply line is supplied to the gate of the third MOS transistor during operation and the voltage of the second power supply line is supplied thereto during standby, and the output terminal is connected to the first power supplied line during standby.

Preferably, in the present invention, a drain voltage of the first MOS transistor is supplied to the gate thereof during operation and the voltage of the second power supply line is supplied thereto during standby, a drain voltage of the second MOS transistor is supplied to the gate thereof during operation and the voltage of the first power supply line is supplied thereto during standby, and the voltage of the first power supply line is supplied to the gate of the third MOS transistor during operation, and the voltage of the second power supply line is supplied thereto during standby.

Furthermore, according to the present invention, there is provided a voltage generator comprising a first MOS transistor, a first resistance element, and a second resistance element connected in series between a first power supply line and an output terminal; a second MOS transistor having a same conductivity type as the first MOS transistor, a third resistance element, a fourth resistance element, and a third MOS transistor having a different conductivity type from the first MOS transistor connected in series between the output terminal and a second power supply line; wherein the third MOS transistor has a first threshold voltage, and the first and second MOS transistors have a second threshold voltage which has a lower absolute value than that of the first threshold voltage, and an intermediate voltage of the first power supply line and the second power supply line is output from the output terminal.

Preferably, in the present invention, the source and the channel forming region of the first MOS transistor are connected to the first power supply line, the source and the channel forming region of the second MOS transistor are connected to the output terminal, and the source and the channel forming region of the third MOS transistor are connected to the second power supply line.

Preferably, in the present invention, the gate of the first MOS transistor is connected to the connection point of the first resistance element and the second resistance element, the voltage of the connection point of the third resistance element and the fourth resistance element is supplied to the gate of the second MOS transistor during operation and the voltage of the first power supply line is supplied thereto during standby, the voltage of the first power supply line is supplied to the gate of the third MOS transistor during operation and the voltage of the second power supply line is supplied thereto during standby, and the output terminal is connected to the first power supplied line during standby.

Preferably, in the present invention, the voltage of the connection point of the first resistance element and the second resistance element is supplied to the gate of the first MOS transistor during operation and the voltage of the second power supply line is supplied thereto during standby, the voltage of the connection point of the third resistance element and the fourth resistance element is supplied to the gate of the second MOS transistor during operation and the voltage of the first power supply line is supplied thereto during standby, the voltage of the first power supply line is supplied to the gate of the third MOS transistor during operation and the voltage of the second power supply line is supplied thereto during standby.

Furthermore, according to the present invention, there is provided a reference voltage generator comprising a first MOS transistor and a second MOS transistor having a same conductivity type, and a first resistance element connected in series between a first power supply line and an output terminal; a third MOS transistor having a same conductivity type as the first MOS transistor, a second resistance element, and a fourth MOS transistor having a different conductivity type from the first MOS transistor connected in series between the output terminal and a second power supply line; wherein the first and the fourth MOS transistors have first threshold voltages of approximately equivalent absolute values, and the second and the third MOS transistors have a second threshold voltage which has a lower absolute value than that of the first threshold voltage, and an intermediate voltage of the first power supply line and the second power supply line is output from the output terminal.

Preferably, in the present invention, the source and the channel forming region of the first MOS transistor are connected to the first power supply line, the source of the second MOS transistor is connected to the drain of the first MOS transistor, and the channel forming region of the second MOS transistor is connected to the first power supply line, the source and the channel forming region of the third MOS transistor are connected to the output terminal, and the source and the channel forming region of the fourth MOS transistor are connected to the second power supply line.

Preferably, in the present invention, the voltage of the second power supply line is supplied to the gate of the first MOS transistor, the gate of the second MOS transistor is connected to the output terminal, the voltage of the first power supply line is supplied to the gate of the second MOS transistor during operation, the voltage of the second power supply line is supplied to the gate of the third MOS transistor during operation and the voltage of the first power supply line is supplied thereto during standby, and the voltage of the first power supply line is supplied to the gate of the fourth MOS transistor during operation and the voltage of the second power supply line is supplied thereto during standby.

Furthermore, according to the present invention, there is provided a reference voltage generator comprising a first MOS transistor of a first conductivity type, a second MOS transistor of the same first conductivity type, and a first resistance element connected in series between a first power supply line and an output terminal; a third MOS transistor of the first conductivity type, a second resistance element, and a fourth MOS transistor of a second conductivity type different from that of the first MOS transistor connected in series between the output terminal and a second power supply line; a fifth MOS transistor of the first conductivity type, a third resistance element, and a sixth MOS transistor of the second conductivity type connected in series between the first power supply line and the output terminal; a fourth resistance element, a seventh MOS transistor of the second conductivity type, and an eighth MOS transistor of the second conductivity connected in series between the output terminal and the second power supply line, wherein the first, the fourth, the fifth and the eighth MOS transistors have first threshold voltages of approximately equivalent absolute values, and the second, the third, the sixth and the seventh MOS transistors have a second threshold voltage which has a lower absolute value than that of the first threshold voltage, and an intermediate voltage of the first power supply line and the second power supply line is output from the output terminal.

Preferably, in the present invention, the voltage of the output terminal is supplied to the gate of the second MOS transistor, the voltage of the second power supply line is supplied to the gate of the third MOS transistor, the voltage of the first power supply line is supplied to the gate of the sixth MOS transistor and the voltage of the output terminal is supplied to the gate of the seventh MOS transistor.

Further, in the present invention, preferably, the voltage of the second power supply line is supplied to the gate of the first and the fifth MOS transistors during operation and the voltage of the first power supply line is supplied thereto during standby, and the voltage of the first power supply line is supplied to the gate of the fourth and the eighth MOS transistors during operation and the voltage of the second power supply line is supplied thereto during standby.

Furthermore, according to the present invention, there is provided a reference voltage generator comprising a first MOS transistor of a first conductivity type, a second MOS transistor of the same first conductivity type, and a first resistance element connected in series between a first power supply line and an output terminal; a third MOS transistor of the first conductivity type, a second resistance element, and a fourth MOS transistor of a second conductivity type different from that of the first MOS transistor connected in series between the output terminal and a second power supply line; a third resistance element and a fifth MOS transistor of the second conductivity type connected in series between the connection point of the first MOS transistor and the second MOS transistor and the output terminal; a fourth resistance element and a sixth MOS transistor of the second conductivity type connected in series between the output terminal and the connection point of the second resistance element and the fourth MOS transistor, wherein the first and the fourth MOS transistors have first threshold voltages of approximately equivalent absolute values, the second, the third, the fifth and the sixth MOS transistors have a second threshold voltage which has a lower absolute value than that of the first threshold voltage, and an intermediate voltage of the first power supply line and the second power supply line is output from the output terminal.

Preferably, in the present invention, the voltage of the output terminal is supplied to the gate of the second MOS transistor, the voltage of the second power supply line is supplied to the gate of the third MOS transistor, the voltage of the first power supply line is supplied to the gate of the fifth MOS transistor and the voltage of the output terminal is supplied to the gate of the sixth MOS transistor.

Preferably, in the present invention, the voltage of the second power supply line is supplied to the gate of the first MOS transistor during operation and the voltage of the first power supply line is supplied thereto during standby, and the voltage of the first power supply line is supplied to the gate of the fourth MOS transistor during operation and the voltage of the second power supply line is supplied thereto during standby.

DESCRIPTION OT THE PREFERRED EMBODIMENTS

Figure 1:
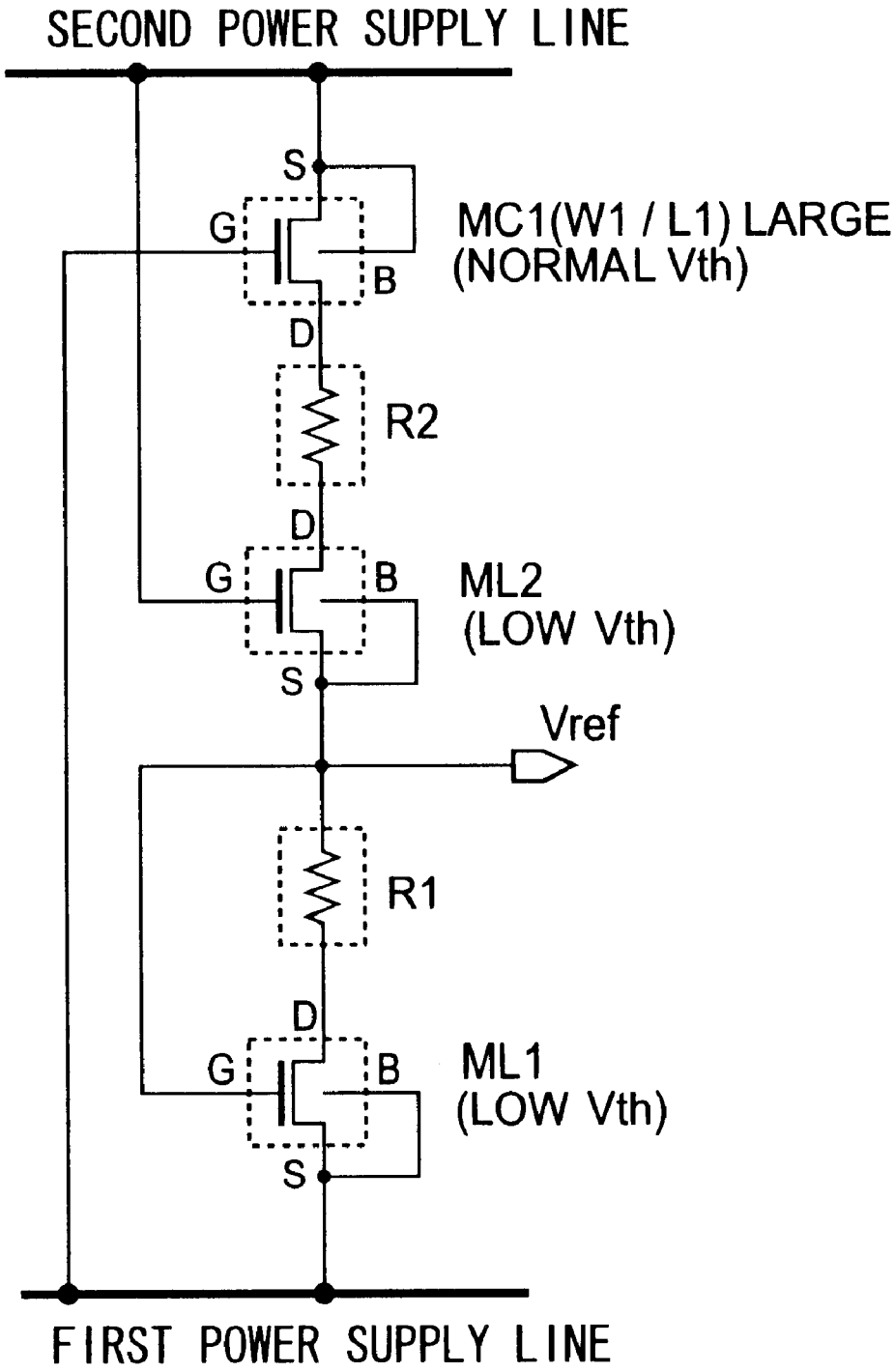
FIG. 1 is a circuit diagram of a first example of a configuration showing the principle of a reference voltage generator according to the present invention.
Figure 2:
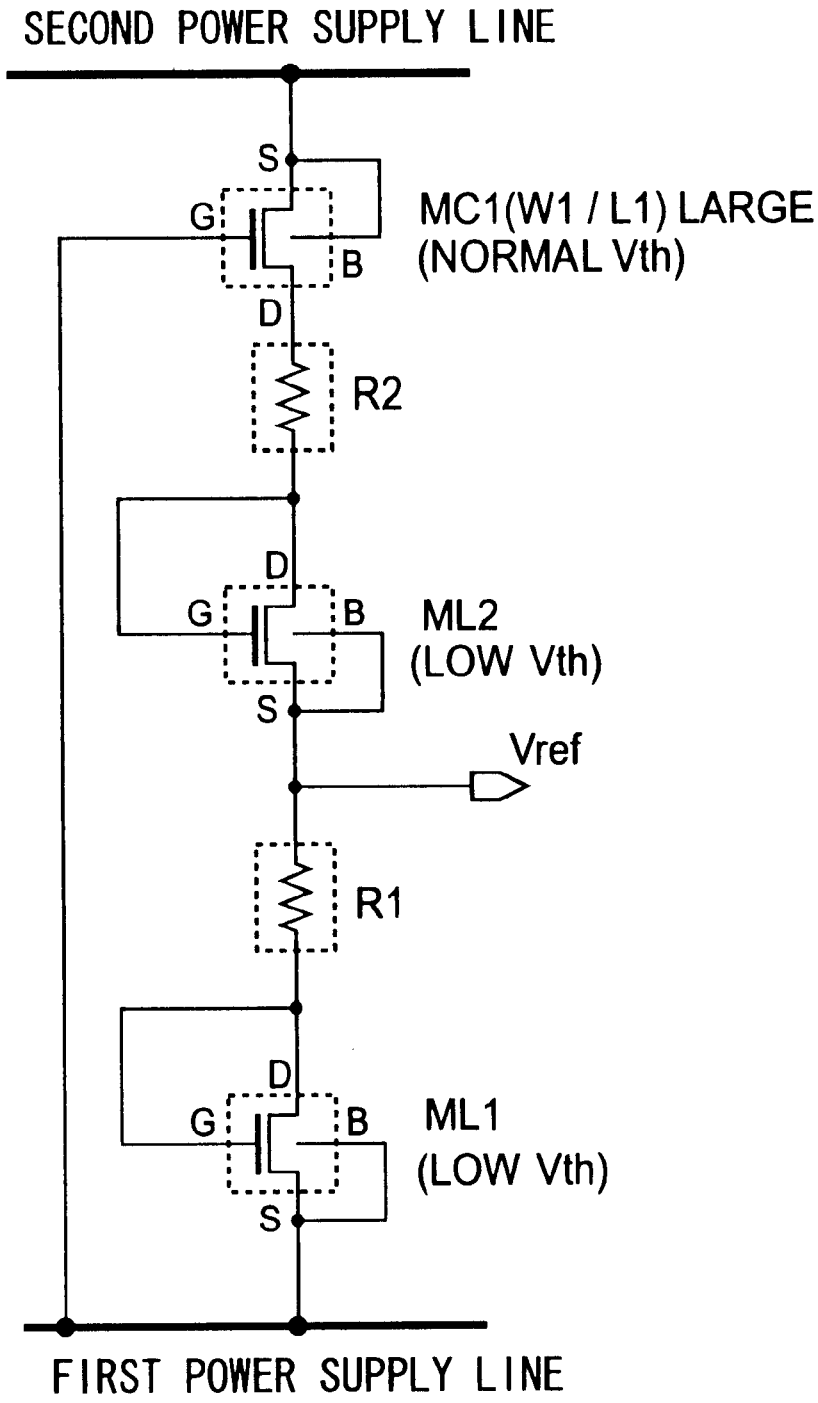
FIG. 2 is a circuit diagram of a second example of a configuration showing the principle of a reference voltage generator according to the present invention.
Figure 3:
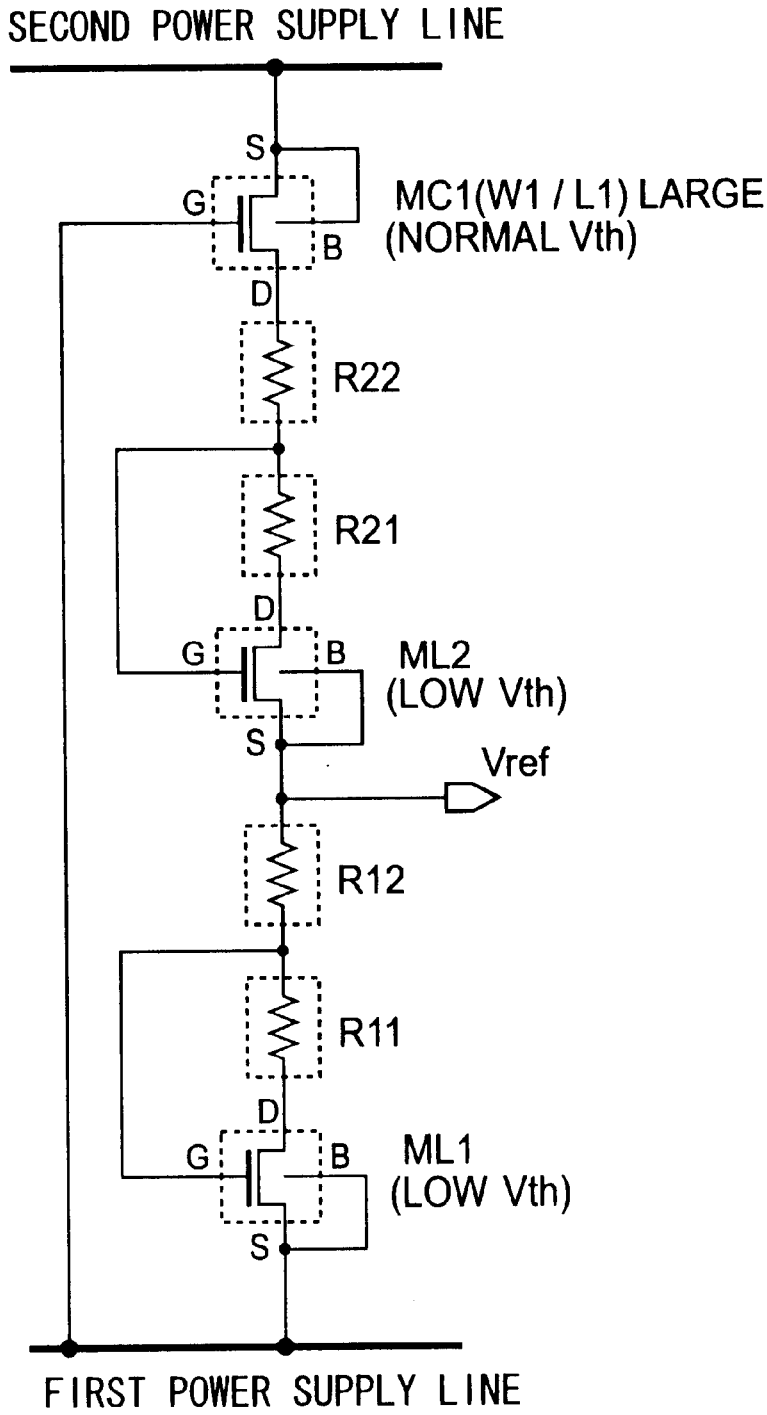
FIG. 3 is a circuit diagram of a third example of a configuration showing the principle of a reference voltage generator according to the present invention.

FIGS. 1 to 3 are principle diagrams showing an operating principle of a reference voltage generator of the present invention.

As illustrated in the drawing, the reference voltage generator of the present invention is constituted by MOS transistors and resistance elements connected in series between a supply line (second power supply line) of a power source voltage $V_{dd}$ and a common electric potential line (first power supply line).

For example, the reference voltage generator as illustrated in FIG. 1 is constituted by MOS transistors MC1, ML1, ML2 and resistance elements R1, R2 connected in series between the supply line of the power source voltage $V_{dd}$ (hereinafter referred to as the power supply line for convenience) and the common potential line. The reference voltage generator illustrated in FIG. 2, in comparison with the reference voltage generator as illustrated in FIG. 1, is constituted by the same circuit elements. However, in the reference voltage generator of FIG. 2, bias voltages supplied to the gates of the MOS transistors are different from those of the reference voltage generator shown in FIG. 1

Further, in the reference voltage generator as illustrated in FIG. 3, in comparison with the reference voltage generators illustrated in FIG. 1 and FIG. 2, the resistance element R1 is substituted by two resistance elements R11 and R12 connected in series, and the resistance element R2 is substituted by two resistance elements R21 and R22 connected in series. A voltage from a connection point of the resistance elements R11 and R12 is supplied to the gate of the MOS transistor ML1, and a voltage from a connection point of the resistance elements R21 and R22 is supplied to the gate of the MOS transistor ML2.

Note that in the reference voltage generators illustrated in FIGS. 1 to 3, the MOS transistor MC1 has a conductivity type different from the other two MOS transistors ML1, ML2. For example, the transistor MC1 is constituted by a pMOS transistor while the transistors ML1 and ML2 are constituted by nMOS transistors. Further, the pMOS transistor MC1 is a transistor having a normal threshold voltage $V_{thp}$, while the nMOS transistors ML1 and ML2 are so called low threshold transistors, which have a threshold voltage $V_{thn}$ that is lower than a normal one.

Below, an operation of the reference voltage generator of the present invention shown in FIG. 1 will be explained.

In the reference voltage generator illustrated in FIG. 1, during operation, an intermediate voltage $V_{ref}$ is supplied to the gate of the transistor ML1, an electric potential of the second power supply line is supplied to the gate of the transistor ML2, and an electric potential of the first power supply line is supplied to the gate of the transistor ML1. Accordingly, the transistors ML1, ML2 and MC1 are held in the conductive state.

Preferably, the transistors ML1 and ML2 have the same transistor size, while the transistor MC1 is sufficiently larger in terms of (W/L) than the transistors ML1 and ML2, and has a large ON resistance, which can be ignored. Furthermore, the resistance elements R1 and R2 are formed as resistance elements having almost the same resistance value.

Furthermore, preferably, the deviation of the output voltage $V_{ref}$ from $V_{dd}/2$ due to the existence of the ON resistance of the transistor MC1, can be compensated by adjusting the transistor size of the transistors ML1 and ML2 in a small amount, or adjusting the resistance values of the resistance elements R1 and R2 in a small amount.

As described above, in the reference voltage generator of the present invention, when the power source voltage is in a low range, assuming that the resistance values of the resistance elements R1 and R2 being adequately smaller than the ON resistance values of the MOS transistors ML1 and ML2, and in addition, the threshold voltage of the transistors ML1 and ML2 being $V_{thl}$, the minimum operation power source voltage $V_{ddmin}$ is practically determined by $2V_{thl}$.

On the other hand, in a range where the power source voltage is high, the resistance values of the resistance elements R1 and R2 has approximately the same resistance value as or higher than the ON resistance values of the transistors ML1 and ML2, and can suppress the current flowing in the transistors ML1 and ML2 from increasing rapidly in the range where the power source voltage $V_{dd}$ is high.

Below, an explanation will be made of a configuration and an operation of the reference voltage generator shown in FIG. 2 while comparing with the reference voltage generator shown in FIG. 1.

As shown in FIG. 2, a gate bias voltage of the transistor ML2 is different in this reference voltage generator compared with the reference voltage generator shown in FIG. 1. Namely, in the reference voltage generator shown in FIG. 1, an output voltage $V_{ref}$ is supplied to the gate of the transistor ML1 and an electric potential of the second power supply line is supplied to the gate of the transistor ML2. On the contrary, the drain voltages of the transistors ML1 and ML2 are supplied to each of their own gates in the reference voltage generator of this example. That is, the transistors ML1 and ML2 are connected as diodes in the reference voltage generator of this example.

Therefore, the minimum operation power source voltage $V_{ddmin}$ is approximately the same value as that of the reference voltage generator shown in FIG. 1, but in the high range of the power source voltage, since the voltages between the gates and the sources of the transistors ML1 and ML2 is held at a smaller value than the case of the reference voltage generator shown in FIG. 1, the currents in these transistors are controlled to be smaller. Therefore, reduced power consumption can be achieved when operating in the high range of the power source voltage.

However, in this example of the reference voltage generator, since the current values of the transistors ML1 and ML2 are determined by the transistors themselves, they are more susceptible to be affected by the fluctuation of the threshold voltages of the MOS transistors and a parameter $I_{ds}$ than the reference voltage generator shown in FIG. 1. Namely, the driving ability of the transistors declines due to the declining voltage between the gates and the sources of the transistors, and thus there is a tendency that the stability of the output intermediate voltage $V_{ref}$ will slightly decline.

In the reference voltage generator shown in FIG. 3, when operating at a high power source voltage, the resistors R1 and R2 that suppress the rapid increase of the current in the transistors are substituted by the resistance elements R11, R12 and R21, R22 connected in series, respectively. The voltage from the connection point of the resistance elements R11 and R12 is supplied to the gate of the transistor ML1, and the voltage from the connection point of the resistance elements R21 and R22 is supplied to the gate of the transistor ML2.

In the reference voltage generator being constituted this way, the minimum operation power source voltage $V_{ddmin}$ is almost the same as that of the reference voltage generator shown in FIG. 1 and FIG. 2. However, in the high range of the power source voltage, the characteristic of the current flowing in the transistors has the intermediate characteristic of the transistors' currents of the reference voltage generator shown in the FIG. 1 and FIG. 2 described above.

Namely, in this example of the reference voltage generator, during operation, the voltages between the gates and the sources of the transistors ML1 and ML2 are lower than those of the reference voltage generator shown in FIG. 1 but higher than those of the reference voltage generator shown in FIG. 2. Therefore, when operating at a high power source voltage of the same level, the current flowing in the transistors ML1 and ML2 of this example of the reference voltage generator is smaller than that of the reference voltage generator shown in FIG. 1, but is larger than that of the reference voltage generator shown in FIG. 2.

As described above, in the reference voltage generators shown in FIGS. 1 to 3, the driving current of the MOS transistors is controlled by the voltages between the gates and the sources of the MOS transistors ML1 and ML2 during operation, and the power consumption is determined in the high power source voltage range, too. As shown in FIG. 1, the stability of the output voltage $V_{ref}$ can be improved by keeping the driving current of the transistor high, and as shown in FIG. 2, the power consumption at the high power source voltage during operation can be suppressed by keeping the driving current of the transistor low. Therefore, in accordance with whether giving priority to the driving ability in response to the status of the load or to the reduction of the power consumption, by appropriately selecting the reference voltage generator shown in FIG. 1, FIG. 2 or FIG. 3, a reference voltage generator corresponding to the purpose can be achieved.

Next, explanations will be made of several embodiments of the present invention based on the principle configuration diagrams described above with reference to the configuration diagrams and the concrete circuit diagrams, respectively.

First Embodiment

Figure 4:
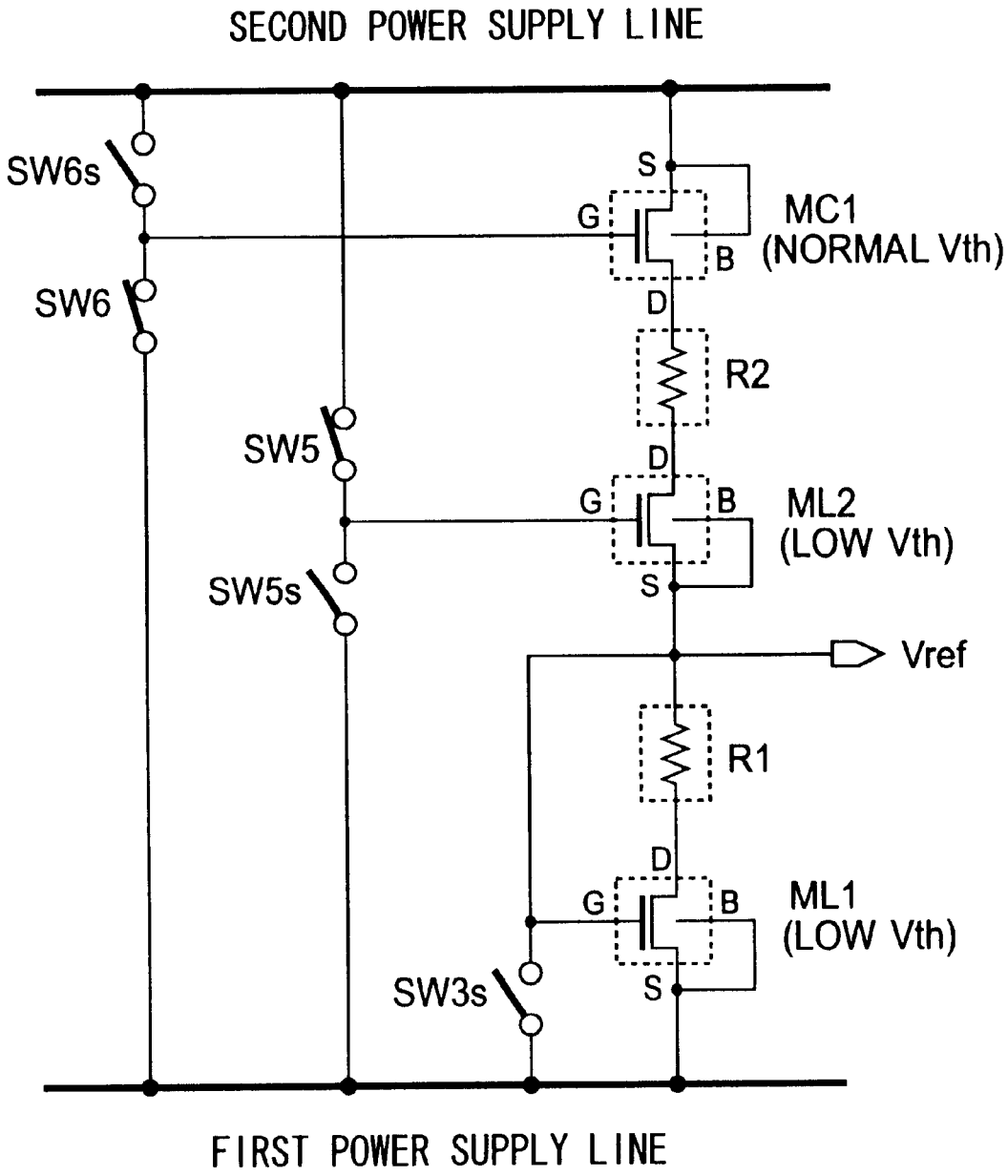
FIG. 4 is an example of a configuration showing a first embodiment of the reference voltage generator according to the present invention.

FIG. 4 is a configuration diagram showing a first embodiment of the reference voltage generator according to the present invention.

As shown in this figure, the reference voltage generator of the present embodiment is constituted by a MOS transistor MC1, MOS transistors ML1 and ML2 having a conductivity type different from the MOS transistor MC1, resistance elements R1, R2, and switching elements SW3*s*, SW5, SW5*s*, SW6, SW6*s*.

The transistor MC1 is a transistor having a normal threshold voltage, the transistors ML1 and ML2 are low threshold voltage transistors having lower threshold voltages than a normal one. Note that in the reference voltage generator of the present embodiment, since the lowest operational power source voltage is determined by the threshold voltages of the transistors ML1 and ML2, the range of the operational power source voltage can be widened by using the low threshold voltage transistors ML1 and ML2.

The transistor MC1, the resistance element R2, the transistor ML2, the resistance element R1 and the transistor ML1 are connected in series as expressed between the second power supply line and the first power supply line. The voltage supplied to the gate of the transistor ML1 is controlled by the switching element SW3*s*, the voltage supplied to the gate of the transistor ML2 is controlled by the switching elements SW5 and SW5*s*, and furthermore the voltage supplied to the gate of the transistor MC1 is controlled by the switching elements SW6 and SW6*s*. The voltage of the second power supply line is supplied to the channel forming region of the transistor MC1, the output voltage $V_{ref}$ is supplied to the channel forming region of the transistor ML2, and the voltage of the first power supply line is supplied to the channel forming region of the transistor ML1.

During operation, the switching elements SW5 and SW6 are rendered ON and the switching elements SW3*s*, SW5*s* and SW6*s* are rendered OFF. Namely, during operation, the electric potential of the first power supply line is supplied to the gate of the transistor MC1, the electric potential of the second power supply line is supplied to the gate of the transistor ML2, and the output voltage $V_{ref}$ is supplied to the gate of the transistor ML1. According to this, during operation, the transistors MC1, ML1 and ML2 are held in the conductive state.

On the other hand, during standby, the switching element SW5 and SW6 are rendered OFF, and the switching elements SW3*s*, SW5*s* and SW6*s* are rendered ON. Namely, during standby, the electric potential of the second power supply line is supplied to the gate of the transistor MC1, the electric potential of the first power source is supplied to the gate of the transistor ML2, and the electric potential of the first power supply line is supplied to the gate of the transistor ML1 too. Due to this, during operation, the transistors MC1, ML1 and ML2 are held in the nonconductive state.

Figure 5:
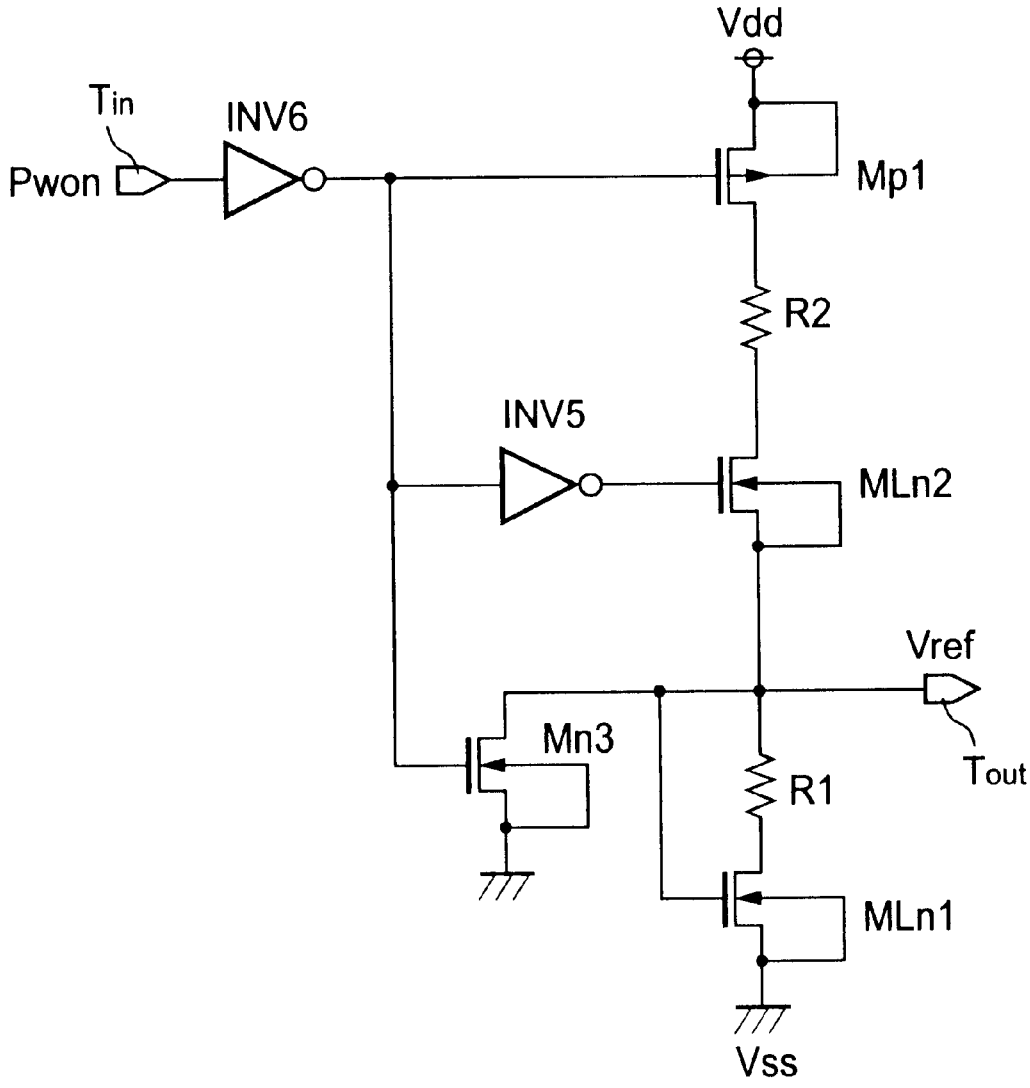
FIG. 5 is a circuit diagram showing the first embodiment of the reference voltage generator according to the present invention.
Figure 6:
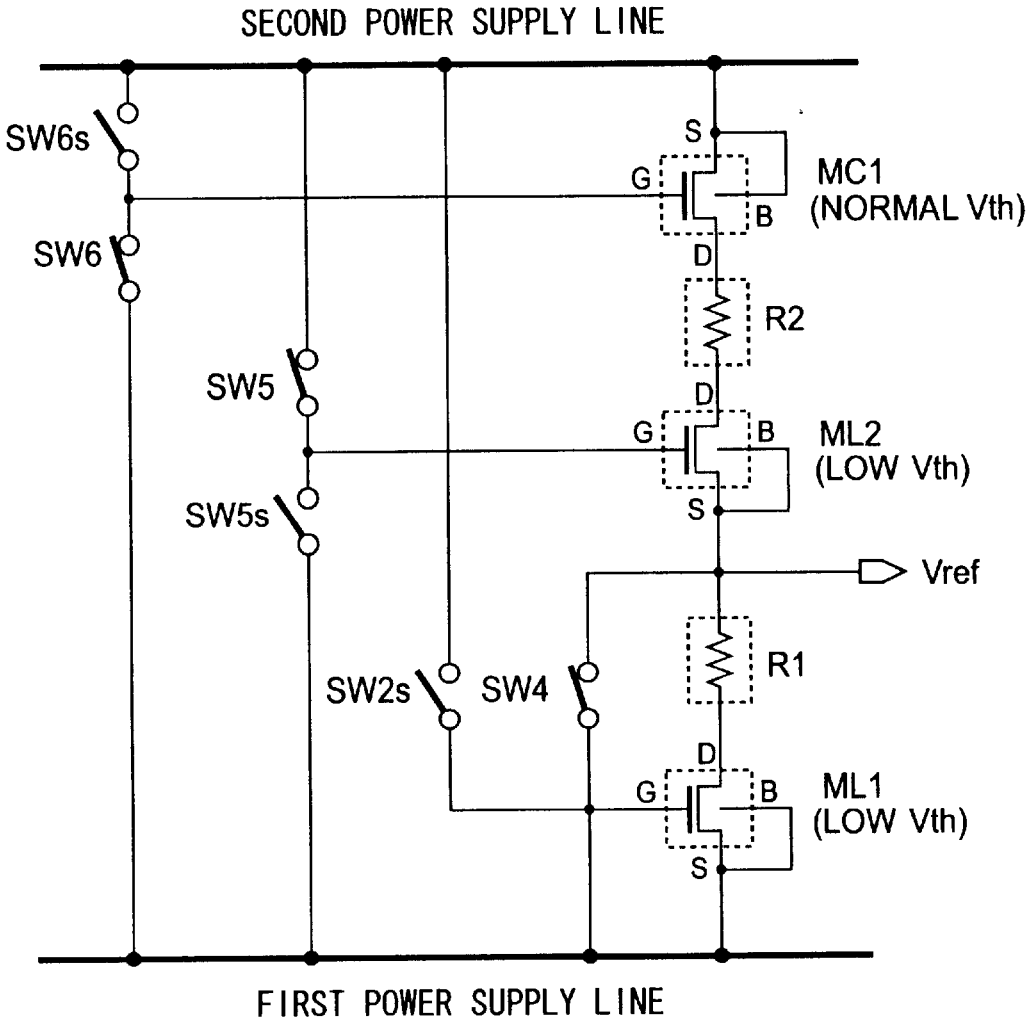
FIG. 6 is an example of a configuration showing a second embodiment of the reference voltage generator according to the present invention.

FIG. 5 is a circuit diagram showing a concrete circuit configuration of the reference voltage generator of the present embodiment. As shown in this diagram, the reference voltage generator of the present embodiment is constituted by a pMOS transistor Mp1, a resistance element R2, an nMOS transistor MLn2, a resistance element R1, nMOS transistors MLn1 and Mn3, and inverters INV5, INV6, which are connected in series between the power supply line of the power source voltage $V_{dd}$ and the common potential line.

The pMOS transistor Mp1 is a transistor having a normal threshold voltage (for example, −0.7V), while the nMOS transistors MLn1 and MLn2 are low threshold voltage transistors having low threshold voltages (for example, 0.2~0.5V) that are lower than normal ones. In the reference voltage generator of the present embodiment, the range of the power source voltage that is operational becomes wider by using the low threshold voltage transistors MLn1 and MLn2.

The source of the transistor Mp1 is connected to the supply line of the power source voltage $V_{dd}$, and the drain thereof is connected to the resistance element R2. The drain of the transistor MLn2 is connected to the resistance element R2, and the source thereof is connected to the resistance element R1. The drain of the transistor MLn1 is connected to the resistance element R1, and the source thereof is connected to the common potential line. An output terminal $T_{out}$ is formed by the connection point of the source of the transistor MLn2 and the resistance element R1. The power source voltage $V_{dd}$ is supplied to the channel forming region of the transistor Mp1, the output voltage $V_{ref}$ is supplied to the channel forming region of the transistor MLn2, and the common potential $V_{SS}$ is supplied to the channel forming region of the transistor MLn1.

An input terminal of the inverter INV6 is connected to an input terminal $T_{in}$, an output terminal thereof is connected to the gate of the transistor Mp1, an input terminal of the inverter INV5 and the gate of the transistor Mn3. The output terminal of the inverter INV5 is connected to the gate of the transistor MLn2. The drain of the transistor Mn3, along with the gate of the transistor MLn1, is connected to the output terminal $T_{out}$.

A power-on signal $P_{won}$ is inputted to the input terminal $T_{in}$. The power-on signal $P_{won}$ is held in the high level during operation and held in the low level during standby.

Below, an explanation will be made of an operation of the reference voltage generator of the present embodiment by referring to FIG. 5.

During operation, since the power-on signal $P_{won}$ is held in the high level, the output terminal of the inverter INV6 is held in the low level and the output terminal of the inverter INV5 is held in the high level. In response to this, the pMOS transistor Mp1 and the nMOS transistor MLn2 are in the conductive state, and the transistor Mn3 is in the nonconductive state. Furthermore, since the output voltage $V_{ref}$ is supplied to the gate of the nMOS transistor MLn1, the transistor MLn1 is in the conductive state, too. Namely, during operation, the transistors Mp1, MLn2 and MLn1 are all in the conductive state. At this time, the voltage $V_{ref}$ of the output terminal $T_{out}$ is set by the dividing ratio determined by the ON resistances of these transistors and the resistance values of the resistance elements R1, R2. By appropriately setting the ON resistances of the transistors and the resistance values of the resistance elements R1, R2, the output voltage of the output terminal $T_{out}$ can be controlled at the intermediate voltage $V_{dd}/2$ of the power supply voltage $V_{dd}$.

During standby, since the power-on signal $P_{won}$ is held in the low level, the output terminal of the inverter INV6 is held in the high level while the output terminal of the inverter INV5 is held in the low level. In response to this, the pMOS transistor Mp1 and the nMOS transistor MLn2 are held in the nonconductive state. Furthermore, since the transistor Mn3 is in the conductive state, the output terminal $T_{out}$ is held at the common potential $V_{SS}$. Namely, the transistor MLn1 is also held in the nonconductive state since the gate of the nMOS transistor MLn1 is held at the common potential $V_{SS}$.

During standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the range of low power source voltage, the resistance values of the resistance elements R1 and R2 are adequately smaller than the ON resistance values of the MOS transistors MLn1 and MLn2, so that the currents in the transistors MLn1 and MLn2 are practically determined by the ON resistances of these transistors.

On the other hand, when operating in the high range of the power source voltage, the ON resistances of the transistors MLn1 and MLn2 decline. Since the resistance values of the resistance elements R1 and R2 are set to a value approximately the same level or higher than the ON resistance values of the transistors MLn1 and MLn2, the currents in the transistors MLn1 and MLn2 are determined by the resistance elements R1 and R2. The rapid increase of the currents can thus be suppressed when operating in the high power source voltage.

As explained above, according to the present embodiment, the pMOS transistor Mp1, the resistance element R2, the nMOS transistor MLn2, the resistance element R1, and the nMOS transistor MLn1 connected in series between the supply line of the power source voltage $V_{dd}$ and the common potential line are provided, during operation, by dividing the power source voltage $V_{dd}$ with the dividing ratio determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the nMOS transistor MLn1, MLn2 having low threshold voltages, in the high range of the power source voltage $V_{dd}$, the rapid increase of the currents in the transistors can be prevented, the stabilized reference voltage in a wide range of the power source voltage can be supplied, and the increase of the power consumption can be suppressed in the high range of the power source voltage.

Second Embodiment

FIG. 5 is a configuration diagram showing a second embodiment of the reference voltage generator according to the present invention.

As shown in this diagram, the reference voltage generator of the present embodiment is constituted by a MOS transistor MC1, transistors ML1 and ML2 having a conductivity type different from the MOS transistor MC1, resistance elements R1, R2 and switching elements SW2*s*, SW4, SW5, SW5*s*, SW6, SW6*s*.

The transistor MC1 is a transistor having a normal threshold voltage, the transistors MC1 and ML2 are low threshold voltage transistors having threshold voltages lower than a normal threshold voltage. Note that in the reference voltage generator of the present embodiment, since the lowest operational power source voltage is determined by the threshold voltages of the transistors ML1 and ML2, the range of the operational power source voltage can be widened by using the low threshold voltage transistors ML1 and ML2.

The transistor MC1, the resistance element R2, the transistor ML2, the resistance element R1, and the transistor ML1 are connected in series as expressed between the second power supply line and the first power supply line. The voltage supplied to the gate of the transistor ML1 is controlled by the switching elements SW2*s* and SW4, the voltage supplied to the gate of the transistor ML2 is controlled by the switching elements SW5 and SW5*s*, and the voltage supplied to the gate of the transistor MC1 is controlled by the switching elements SW6 and SW6*s*.

During operation, the switching elements SW4, SW5 and SW6 are rendered ON while the switching elements SW2*s*, SW5*s* and SW6*s* are rendered OFF. Namely, the electric potential of the first power supply line is supplied to the gate of the transistor MC1, the electric potential of the second power supply line is supplied to the gate of the transistor ML2, and the output voltage $V_{ref}$ is supplied to the gate of the transistor ML1 during operation. Accordingly, during operation, the transistors MC1, ML1 and ML2 are held in the conductive state.

On the other hand, during standby, the switching element SW4, SW5 and SW6 are rendered OFF, and the switching elements SW2*s*, SW5*s* and SW6*s* are rendered ON. Accordingly, during standby, the electric potential of the second power supply line is supplied to the gate of the transistor MC1, the electric potential of the first power supply line is supplied to the gate of the transistor ML2, and the electric potential of the second power supply line is supplied to the gate of the transistor ML1. Therefore, during standby, the transistors MC1 and ML2 are held in the nonconductive state, while the transistors ML1 is held in the conductive state.

Figure 7:
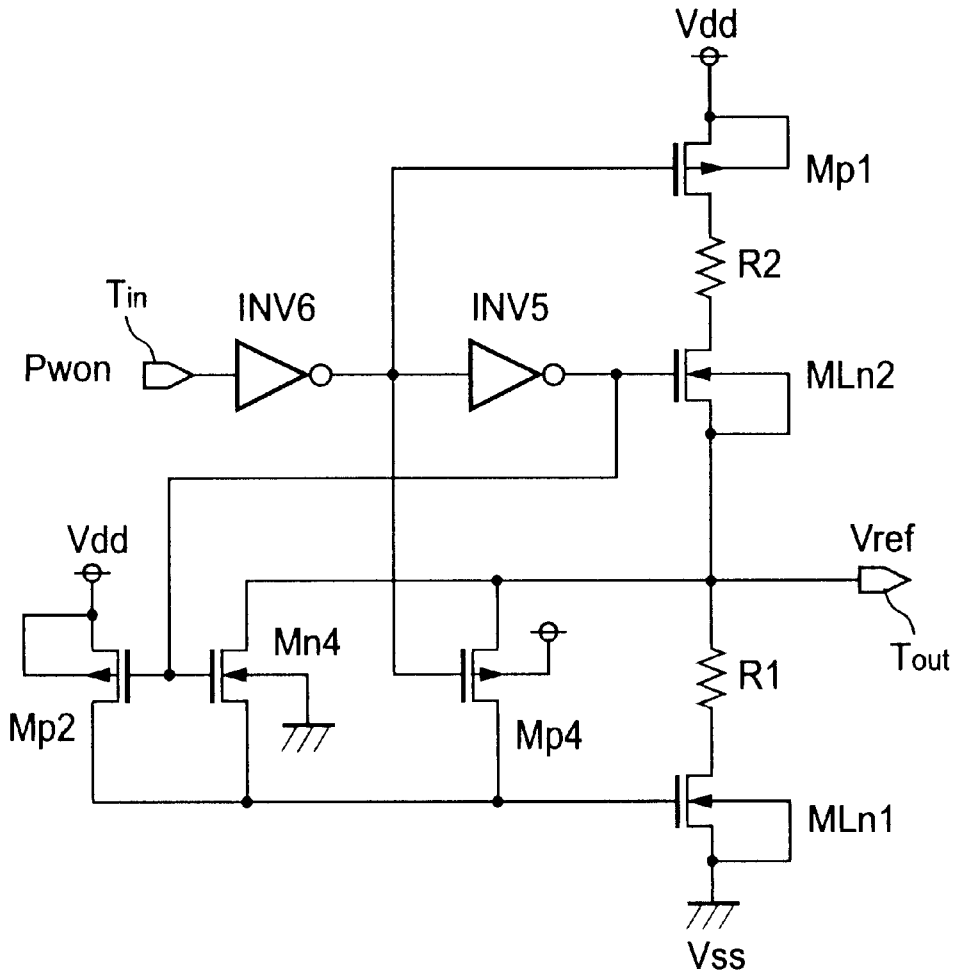
FIG. 7 is a circuit diagram showing the second embodiment of the reference voltage generator according to the present invention.

FIG. 7 is a circuit diagram showing a concrete circuit configuration of the reference voltage generator of the present embodiment. As shown in this diagram, the reference voltage generator of the present embodiment is constituted by a pMOS transistor Mp1, a resistance element R2, an nMOS transistor MLn2, a resistance element R1, an nMOS transistor MLn1, PMOS transistors Mp2, Mp4, an nMOS transistor Mn4, and inverters INV5, INV6 connected in series between the supply line of the power source voltage $V_{dd}$ and the common potential line.

The pMOS transistor Mp1 is a transistor having a normal threshold voltage, while the nMOS transistors MLn1 and MLn2 are low threshold voltage transistors having lower threshold voltage than normal. In the present embodiment, the range of the power source voltage that is operational becomes wider by using the low threshold voltage transistors MLn1 and MLn2.

The source of the transistor Mp1 is connected to the supply line of the power source voltage $V_{dd}$, and the drain thereof is connected to the resistance element R2. The drain of the transistor MLn2 is connected to the resistance element R2, and the source thereof is connected to the resistance element R1. The drain of the transistor MLn1 is connected to the resistance element R1, and the source thereof is connected to the common potential line. The output terminal $T_{out}$ is formed by the connection point of the source of the transistor MLn2 and the resistance element R1. The power source voltage $V_{dd}$ is supplied to the channel forming region of the transistor Mp1, the output voltage $V_{ref}$ is supplied to the channel forming region of the transistor MLn2, the common potential $V_{SS}$ is supplied to the channel forming region of the transistor MLn1.

The input terminal of the inverter INV6 is connected to the input terminal $T_{in}$, the output terminal thereof is connected to the gate of the transistor Mp1, the input terminal of the inverter INV5 and the gate of the transistor Mp4. The output terminal of the inverter INV5 is connected to the gate of the transistor MLn2 and the gates of the transistors Mp2 and Mn4. The source of the transistor Mp2 is connected to the supply line of the power source voltage $V_{dd}$, the drain thereof is connected to the gate of the transistor MLn1.

The drain of the transistor Mn4 is connected to the output terminal $T_{out}$, the source thereof is connected to the gate of the transistor MLn1, the source of the transistor Mp4 is connected to the output terminal $T_{out}$, and the drain thereof is connected to the gate of the transistor MLn1. Namely, the transistors Mn4 and Mp4 constitute a transfer gate provided between the output terminal $T_{out}$ and the gate of the transistor MLn1.

A power-on signal $P_{won}$ is inputted to the input terminal $T_{in}$. The power-on signal $P_{won}$ is held in the high level during operation, and held in the low level during standby.

Below, an explanation will be given of an operation of the reference voltage generator of the present embodiment by referring to FIG. 7.

During operation, since the power-on signal $P_{won}$ is held in the high level, the output terminal of the inverter INV6 is held in the low level, while the inverter INV5 is held in the high level. In response to this, the pMOS transistor Mp1 and the nMOS transistor MLn2 are in the conductive state. Since the transistors Mn4 and Mp4 are in the conductive state and the transistor Mp2 is in the nonconductive state, the voltage of the output terminal $T_{out}$ is supplied to the gate of the transistor MLn1, whereby the transistor MLn1 is in the conductive state, too. Namely, at this time, the transistors Mp1, MLn2 and MLn1 are all in the conductive state. At this time, the voltage $V_{ref}$ of the output terminal $T_{out}$ is set by the dividing ratio determined by the ON resistances of these transistors and the resistance values of the resistance elements R1, R2.

By appropriately setting the ON resistances of the transistors and the resistance values of the resistance elements R1, R2, the output voltage of the output terminal $T_{out}$ can be controlled at the intermediate voltage $V_{dd}/2$ of the power supply voltage $V_{dd}$.

Since the power-on signal $P_{won}$ is held in the low level during standby, the output terminal of the inverter INV6 is held in the high level, while the output terminal of the inverter INV5 is held in the low level. In response to this, the pMOS transistor Mp1 and the nMOS transistor MLn2 are held in the nonconductive state. Furthermore, since the transistor Mp2 is in the conductive state, and the transistors Mp4 and Mn4 are in the nonconductive state, the power source voltage $V_{dd}$ is supplied to the gate of the transistor MLn1. Therefore, the transistor MLn1 is held in the conductive state, whereby the output terminal $T_{out}$ is held at the common potential $V_{SS}$.

During standby, since the output voltage $V_{ref}$ is held at the common potential $V_{SS}$, and both the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the resistance values of the resistance elements R1 and R2 are adequately smaller than the ON resistance values of the MOS transistors MLn1 and MLn2. The currents in the transistors MLn1 and MLn2 are thus practically determined by the ON resistances of these transistors.

On the other hand, when operating in the high range of the power source voltage, the ON resistance of the transistors MLn1 and MLn2 decline. Since the resistance values of the resistance elements R1 and R2 are set to a value approximately the same level as or higher than the ON resistance values of the transistors MLn1 and MLn2, the currents in the transistors MLn1 and MLn2 in the high range of a power source voltage are determined by the resistance elements R1 and R2. The rapid increase of the currents can thus be suppressed when operating at the high power source voltage.

As explained above, according to the present embodiment, the pMOS transistor Mp1, the resistance element R2, the nMOS transistor MLn2, the resistance element R1, and the nMOS transistor MLn1 connected in series between the supply line of the power source voltage $V_{dd}$ and the common potential line are provided, and during operation, by dividing the power source voltage $V_{dd}$ with the dividing ratio determined by ON resistance of the transistors and the resistance values of the resistance elements, the intermediate voltage $V_{dd}/2$ of the power source voltage $V_{dd}$ is output as the reference voltage. Therefore, in the reference voltage generator of the present embodiment, while using the nMOS transistors MLn1 and MLn2 having low threshold voltages, in the high range of the power source voltage $V_{dd}$, the rapid increase of the currents in the transistors can be prevented, the stabilized reference voltage in a wide range of the power source voltage can be supplied, and the increase of the power consumption can be suppressed in the high range of the power source voltage.

Third Embodiment

Figure 8:
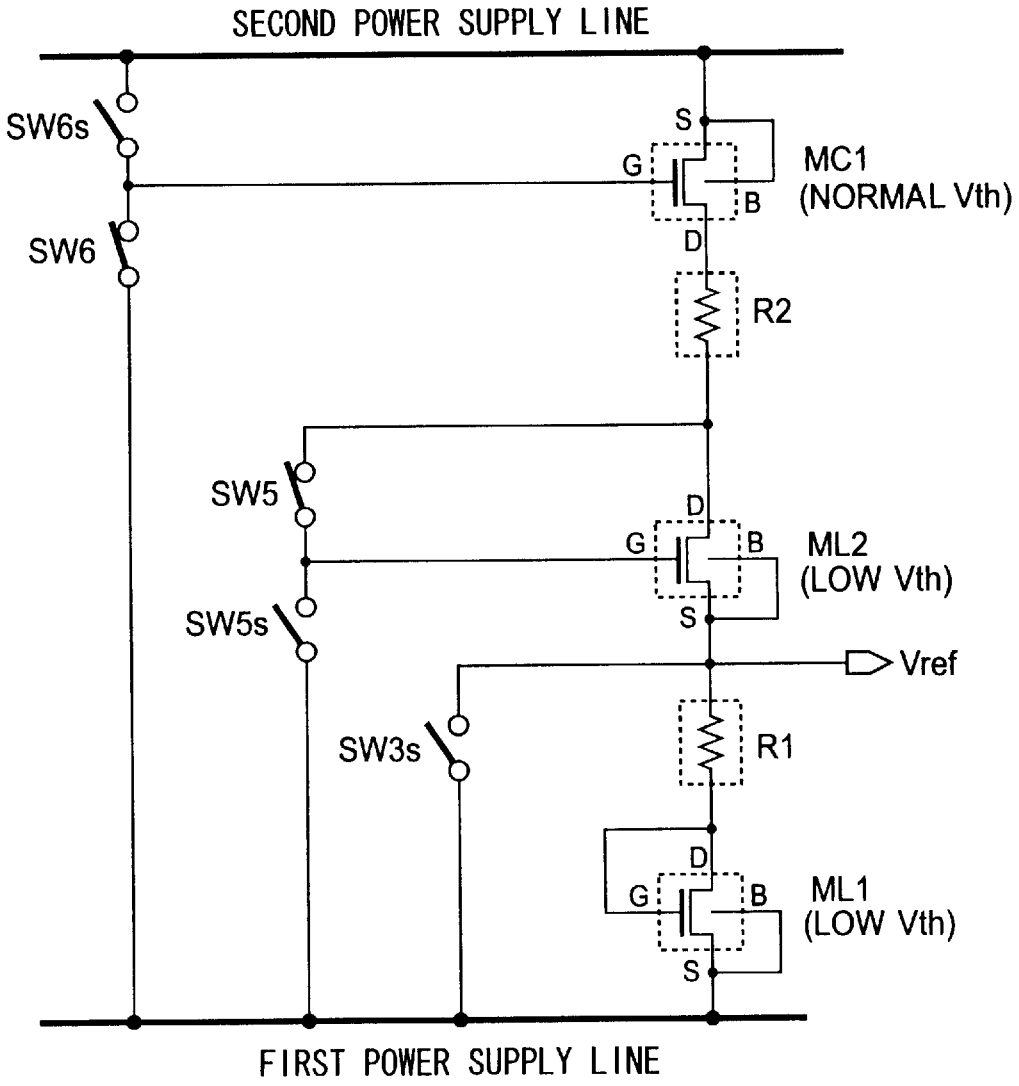
FIG. 8 is an example of a configuration showing a third embodiment of the reference voltage generator according to the present invention.

FIG. 8 is a configuration diagram showing a third embodiment of the reference voltage generator of the present invention.

As shown in this diagram, the reference voltage generator of the present embodiment is constituted by a MOS transistor MC1, transistors ML1, ML2 having a conductivity type different from the MOS transistor MC1, resistance elements R1, R2 and switching elements SW3*s*, SW5, SW5*s*, SW6, SW6*s*.

The transistor MC1 is a transistor which has a normal threshold voltage, while the transistors ML1, ML2 are low threshold voltage transistors having lower threshold voltages than a normal threshold voltage. Note that in the reference voltage generator of this embodiment, since the lowest operational power source voltage is determined by the threshold voltages of the transistors ML1 and ML2, the range of the operational power source voltage can be widened by using the low threshold voltage transistors ML1 and ML2.

The transistor MC1, the resistance element R2, the transistor ML2, the resistance element R1 and the transistor ML1, are connected in series as expressed between the second power supply line and the first power supply line. The drain of the transistor ML1 and the gate thereof are connected. Namely, the transistor ML1 constitutes a diode.

When the switching element SW3*s* is ON, the output voltage $V_{ref}$ is held in the electric potential of the first power supply line. The voltage supplied to the gate of the transistor ML2 is controlled by the switching elements SW5 and SW5*s*, and the voltage supplied to the gate of the transistor MC1 is controlled by switching elements SW6 and SW6*s*.

During operation, the switching elements SW5 and SW6 are rendered ON, and the switching elements SW3*s*, SW5*s* and SW6*s* are rendered OFF. Therefore, the electric potential of the first power supply line is supplied to the gate of the transistor MC1. Since the gate of the transistor ML2 and the drain thereof are connected, the transistor ML2 forms a diode. Accordingly, the transistors MC1 is held in the conductive state during operation, and the transistors ML1 and ML2 form diodes. The output voltage $V_{ref}$ is determined by the dividing ratio which is determined by the ON resistances of the transistors MC1, ML1, ML2 and the resistance values of the resistance elements R1 and R2.

During standby, the switching elements SW5 and SW6 are turned OFF, and the switching elements SW3*s*, SW5*s*, and SW6*s* are turned ON. Accordingly, the electric potential of the second power supply line is supplied to the gate of the transistor MC1, and the electric potential of the first power source is supplied to the gate of the transistor ML2. Therefore, both of the transistors MC1 and ML2 are held in the nonconductive state. Further, the output voltage $V_{ref}$ is held in the electric potential of the first power supply line by the switching element SW3*s*. Namely, the transistors MC1 and ML2 are held in the nonconductive state during standby, and the output voltage $V_{ref}$ is held in the electric potential of the first power supply line.

Figure 9:
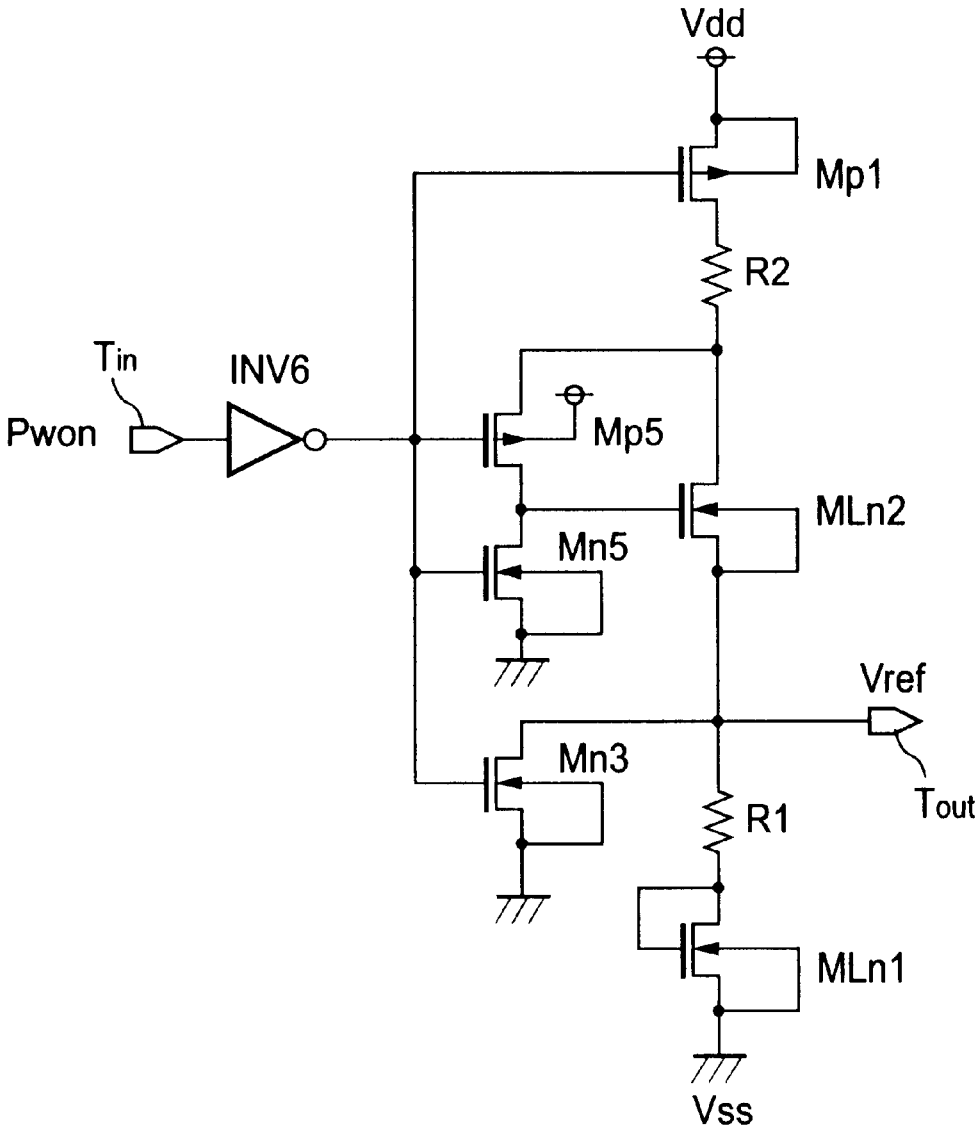
FIG. 9 is a circuit diagram showing the third embodiment of the reference voltage generator according to the present invention.

FIG. 9 is a circuit diagram showing a concrete circuit configuration of the reference voltage generator of the present embodiment. As shown in this diagram, the reference voltage generator of the this embodiment is constituted by a PMOS transistor Mp1, a resistance element R2, an nMOS transistor MLn2, a resistance element R1, nMOS transistors MLn1, Mn3, Mn5, a pMOS transistor Mp5 and an inverter INV6 connected in series between the supply line of the power source voltage $V_{dd}$ and the common potential line.

The pMOS transistor Mp1 is a transistor having a normal threshold voltage, while the nMOS transistors MLn1 and MLn2 are the low threshold voltage transistors having a lower threshold voltage than normal. Like this, in the reference voltage generator of the present embodiment, the range of the power source voltage that is operational becomes wider by using the low threshold voltage transistors MLn1 and MLn2.

The source of the transistor Mp1 is connected to the supply line of the power source voltage $V_{dd}$, and the drain thereof is connected to the resistance element R2. The drain of the transistor MLn2 is connected to the resistance element R2, and the source thereof is connected to the resistance element R1. The drain of the transistor MLn1 is connected to the resistance element R1, and the source thereof is connected to the common potential line. The output terminal $T_{out}$ is formed by the connection point of the source of the transistor MLn2 and the resistance element R1. The power source voltage $V_{dd}$ is supplied to the channel forming region of the transistor Mp1, the output voltage $V_{ref}$ is supplied to the channel forming region of the transistor MLn2, and the common potential $V_{SS}$ is supplied to the channel forming region of the transistor MLn1.

The input terminal of the inverter INV6 is connected to the input terminal $T_{in}$, the output terminal thereof is connected to the gates of the transistors Mp1, Mn3, Mn5 and Mp5. The source of the transistor Mp5 is connected to the connection point of the resistance element R2 and the drain of the transistor MLn2, the drain thereof is connected to the gate of the transistor MLn2. The drain of the transistor Mn5, along with the drain of the transistor Mp5 is connected to the gate of the transistor MLn2, and the source thereof is connected to the common potential line. Furthermore, the drain of the transistor Mn3 is connected to the output terminal $T_{out}$, and the source thereof is connected to the common potential line.

A power-on signal $P_{won}$ is inputted to the input terminal $T_{in}$. The power-on signal $P_{won}$ is held in the high level during operation and held in the low level during standby.

Below, an explanation will be made of an operation of the reference voltage generator of this embodiment by referring to FIG. 9.

During operation, since the power-on signal $P_{won}$ is held in the high level, the output terminal of the inverter INV6 is held in the low level. In response to this, the pMOS transistors Mp1 and MLp5 are in the conductive state. Therefore, the nMOS transistor MLn2 forms a diode since the gate and the drain thereof are connected. Namely, during operation, the transistor Mp1 is in the conductive state and both of the transistors MLn1 and MLn2 form diode. At this time, the voltage $V_{ref}$ of the output terminal $T_{out}$ is set by the dividing ratio determined by the ON resistance of these transistors and the resistance values of the resistance elements R1 and R2. The output voltage of the output terminal $T_{out}$ can be controlled at the intermediate voltage $V_{dd}/2$ of the power supply voltage $V_{dd}$ by appropriately setting the ON resistances of the transistors and the resistance values of the resistance elements R1 and R2.

During standby, since the power-on signal $P_{won}$ is held in the low level, the output terminal of the inverter INV6 is held in the high level. Accordingly, the pMOS transistors Mp1 and Mp5 are held in the nonconductive state. Since the nMOS transistor Mn3 and Mn5 are in the conductive state, the gate of the nMOS transistor MLn2 and the output terminal $T_{out}$ are held at the common potential $V_{SS}$.

Like this, during standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the resistance values of the resistance elements R1 and R2 are adequately smaller than the ON resistance values of the MOS transistors MLn1 and MLn2, and thus the currents in the transistors MLn1 and MLn2 are practically determined by the ON resistances of these transistors.

On the other hand, when operating in the high range of the power source voltage, the ON resistances of the transistors MLn1 and MLn2 decline. Since the resistance elements R1 and R2 are set to a value approximately the same level as or higher than the ON resistance values of the transistors MLn1 and MLn2, the currents in the transistors MLn1 and MLn2 are determined by the resistance elements R1 and R2, whereby rapid increase of the currents can be suppressed when operating at the high power source voltage.

As explained above, in the present embodiment, the pMOS transistor Mp1, the resistance element R2, the nMOS transistor MLn2, the resistance element R1, the nMOS transistor MLn1 connected in series between the supply line of the power source voltage $V_{dd}$ and the common potential line are provided, and during operation, by dividing the power source voltage $V_{dd}$ with the dividing ratio determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the low threshold voltage nMOS transistors MLn1 and MLn2, in the high range of the power source voltage $V_{dd}$, the rapid increase of the currents in the transistors can be avoided, the stabilized reference voltage in a wider range of power source voltage can be supplied, and the increase of the power consumption can be suppressed in the high range of the power source voltage.

Fourth Embodiment

Figure 10:
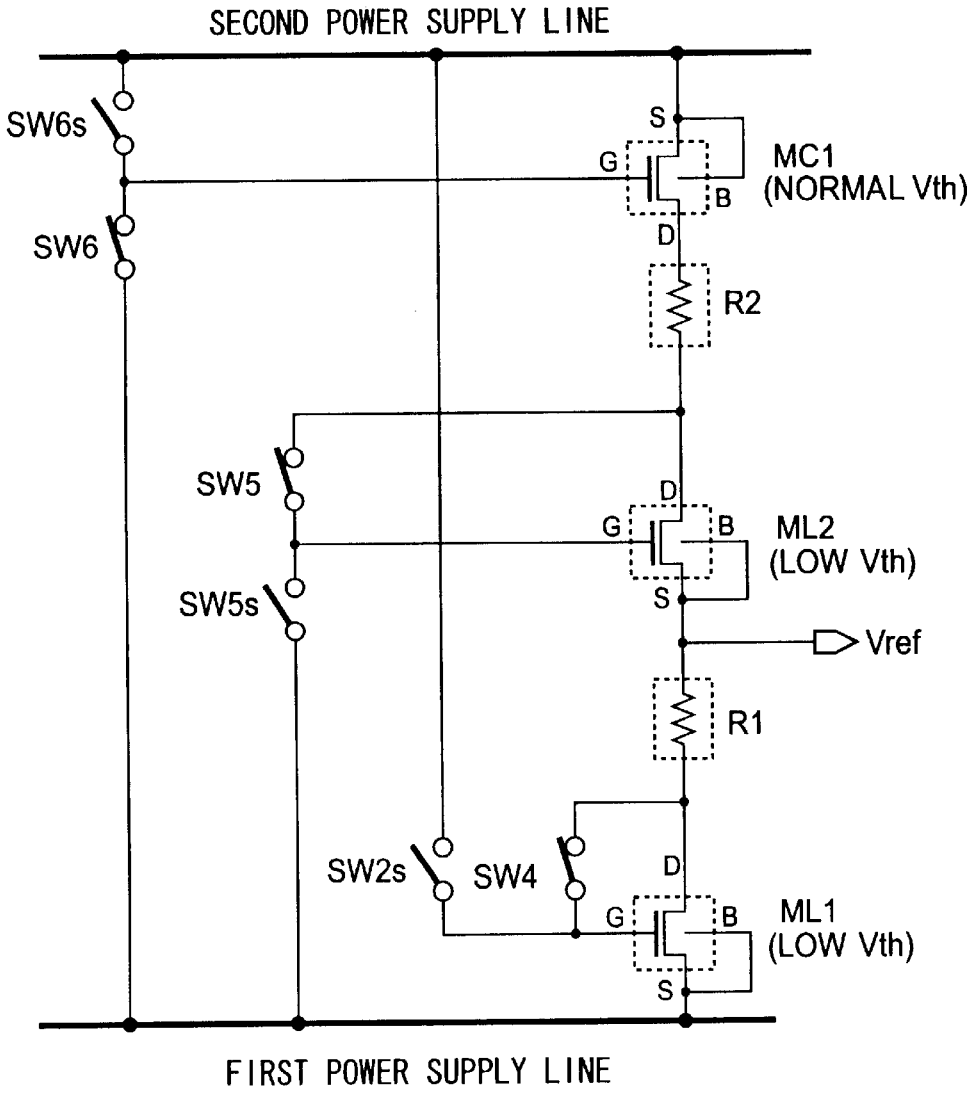
FIG. 10 is an example of a configuration showing a fourth embodiment of the reference voltage generator according to the present invention.

FIG. 10 is a configuration diagram showing a fourth embodiment of the reference voltage generator of the present invention.

As shown in this diagram, the reference voltage generator of the present embodiment is constituted by a MOS transistor MC1, transistors ML1, ML2 having a conductivity type different from the MOS transistor MC1, resistance elements R1, R2 and switching elements SW2*s*, SW4, SW5, SW5*s*, SW6, SW6*s*.

The transistor MC1 is a transistor having a normal threshold voltage, the transistors ML1, ML2 are low threshold voltage transistors having lower threshold voltages than a normal threshold voltage. In the reference voltage generator of the present embodiment, since the lowest operational power source voltage is determined by the threshold voltages of the transistors ML1 and ML2, the range of the operational power source voltage can be widened by using low threshold voltage transistors ML1 and ML2.

The transistor MC1, the resistance elements R2, the transistor ML2, the resistance elements R1 and the transistor ML1 are connected in series as expressed between the second power supply line and the first power supply line. The voltage supplied to the gate of the transistor ML1 is controlled by the switching elements SW2*s* and SW4, the voltage supplied to the gate of the transistor ML2 is controlled by the switching elements SW5 and SW5*s*, and the voltage supplied to the gate of the transistor MC1 is controlled by the switching elements SW6 and SW6*s*.

During operation, the switching elements SW4, SW5 and SW6 are rendered ON, and the switching elements SW2*s*, SW5*s* and SW6*s* are rendered OFF. Therefore, the electric potential of the first power supply line is supplied to the gate of the transistor MC1 during operation. The transistors ML1 and ML2 form diodes since the gates thereof are connected to the drains, respectively. Accordingly, during operation, the output voltage $V_{ref}$ is set by the dividing ratio determined by the ON resistances of the transistors MC1, ML1 and ML2, and the resistance values of the resistance elements R1 and R2.

During standby, the switching element SW4, SW5 and SW6 are rendered OFF, and the switching elements SW2*s*, SW5*s* and SW6*s* are rendered ON. Accordingly, the electric potential of the second power supply line is supplied to the gate of the transistor MC1, the electric potential of the first power source is supplied to the gate of the transistor ML2. Furthermore, the electric potential of the second power supply line is supplied to the gate of the transistor ML1. Therefore, during standby, the transistors MC1 and ML2 are held in the nonconductive state, while the transistors ML1 is held in the conductive state.

Figure 11:
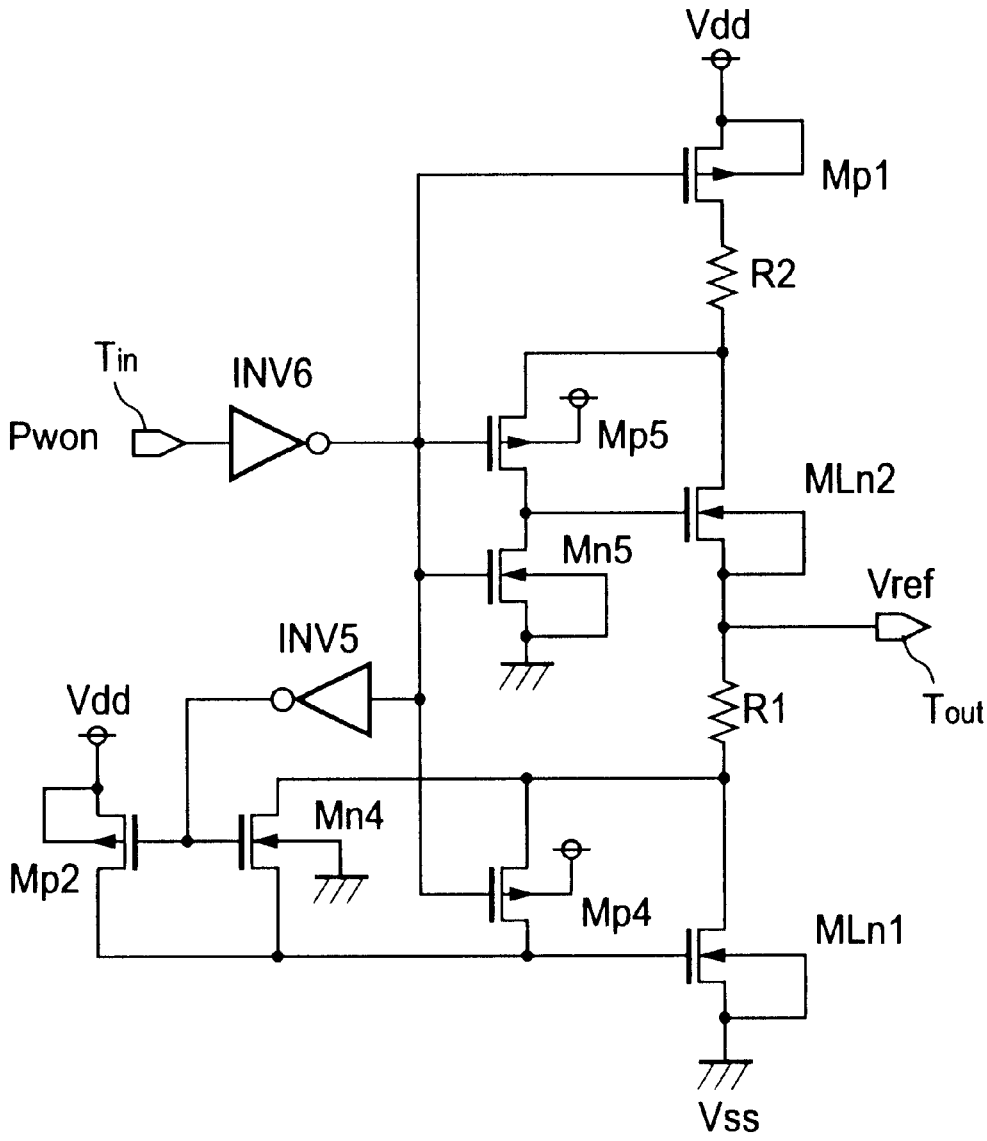
FIG. 11 is a circuit diagram showing the fourth embodiment of the reference voltage generator according to the present invention.

FIG. 11 is a circuit diagram showing a concrete circuit configuration of the reference voltage generator of the present embodiment. As shown in this diagram, the reference voltage generator of the this embodiment is constituted by a pMOS transistor Mp1, a resistance element R2, an nMOS transistor MLn2, a resistance element R1, nMOS transistors MLn1, Mn4, Mn5, pMOS transistors Mp2, Mp4, Mp5, and inverters INV5, INV6 connected in series between the supply line of the power source voltage $V_{dd}$ and the common potential line.

The pMOS transistor Mp1 is a transistor having a normal threshold voltage, while the nMOS transistors MLn1 and MLn2 are low threshold voltage transistors having a threshold voltage that is lower than a normal one. Like this, the range of the power source voltage that is operational becomes wider by using the low threshold voltages MLn1 and MLn2 in the reference voltage generator of the present embodiment.

The source of the transistor Mp1 is connected to the supply line of the power source voltage $V_{dd}$, and the drain thereof is connected to the resistance element R2. The drain of the transistor MLn2 is connected to the resistance element R2, and the source thereof is connected to the resistance element R1. The drain of the transistor MLn1 is connected to the resistance element R1, and the source thereof is connected to the common potential line. The output terminal $T_{out}$ is formed by the connection point of the source of the transistor MLn2 and the resistance element R1. The power source voltage $V_{dd}$ is supplied to the channel forming region of the transistor Mp1, the output voltage $V_{out}$ is supplied to the channel forming region of the transistor MLn2, and the common potential $V_{SS}$ is supplied to the channel forming region of the transistor MLn1.

The input terminal of the inverter INV6 is connected to the input terminal $T_{in}$, the output terminal thereof is connected to the gates of the transistors Mp1, Mp4, Mn5 and Mp5, and the input terminal of the inverter INV5. The output terminal of the inverter INV5 is connected to the gates of the transistors Mp2 and Mn4. The source of the transistor Mp2 is connected to the supply line of the power source voltage $V_{dd}$, and the drain thereof is connected to the gate of the transistor MLn1.

The drain of the transistor Mn4 is connected to the drain of the transistor MLn1, the source thereof is connected to the gate of the transistor MLn1, the source of the transistor Mp4 is connected to the drain of the transistor MLn1, the drain thereof is connected to the gate of the transistor MLn1. Namely, the transistors Mn4 and Mp4 constitutes a transfer gate provided between the drain of the transistor MLn1 and the gate thereof. The source of the transistor Mp5 is connected to the connection point of the resistance element R2 and the drain of the transistor MLn2, the drain thereof is connected to the gate of the transistor MLn2. The drain of the transistor Mn5 along with the drain of the transistor Mp5 is connected to the gate of the transistor MLn2, and the source thereof is connected to the common potential line.

A power-on signal $P_{won}$ is inputted to the input terminal $T_{in}$. The power-on signal $P_{won}$ is held in the high level during operation, and held in the low level during standby.

Below, an explanation will be made of an operation of the reference voltage generator of the present embodiment by referring to FIG. 11.

During operation, since the power-on signal $P_{won}$ is held in the high level, the output terminal of the inverter INV6 is held in the low level, and the output terminal of the inverter INV5 is held in the high level. Accordingly, the pMOS transistors Mp1, Mp4, Mp5, and the nMOS transistor Mn4 are in the conductive state. Therefore the nMOS transistors MLn1 and MLn2 form diodes since the gates and the drains are connected, respectively. Namely, during operation, the transistor Mp1 is in the conductive state, both of the transistors MLn1 and MLn2 form diodes. At this time, the voltage $V_{ref}$ of the output terminal $T_{out}$ is set by the dividing ratio determined by the ON resistances of these transistors and the resistance values of the resistance elements R1 and R2. The output voltage of the output terminal $T_{out}$ can be controlled at the intermediate voltage $V_{dd}/2$ of the power supply voltage $V_{dd}$ by appropriately setting the ON resistances of the transistors and the resistance values of the resistance elements R1 and R2.

During standby, since the power-on signal $P_{won}$ is held in the low level, the output terminal of the inverter INV6 is held in the high level, while the output terminal of the inverter INV5 is held in the low level. Accordingly, the pMOS transistors Mp1, Mp4, Mp5, and the nMOS transistor Mn4 are held in the nonconductive state. Furthermore, since the nMOS transistor Mn5 and the pMOS transistor Mp2 are in the conductive state, the gate of the nMOS transistor MLn2 is held at the common potential $V_{SS}$, and the power source voltage $V_{dd}$ is supplied to the gate of the nMOS transistor MLn1. Therefore, the transistor MLn1 is in the conductive state and the output terminal $T_{out}$ is held at the common potential $V_{SS}$.

Like this, during standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the resistance values of the resistance elements R1 and R2 are adequately smaller than the ON resistance values of the MOS transistors MLn1 and MLn2, and therefore the currents in the transistors MLn1 and MLn2 are practically determined by the ON resistances of these transistors.

On the other hand, when operating in the high range of the power source voltage, the ON resistances of the transistors MLn1 and MLn2 decline. Since the resistance elements R1 and R2 are set to a value approximately the same level as or higher than the ON resistance values of the transistors MLn1 and MLn2, the currents in the transistors MLn1 and MLn2 are determined by the resistance elements R1 and R2, whereby the rapid increase of the currents can be suppressed when operating in the high range of the power source voltage.

As explained above, according to the present embodiment, the pMOS transistor Mp1, the resistance element R2, the nMOS transistor MLn2, the resistance element R1, the nMOS transistor MLn1 connected in series between the supply line and the common potential line of the power source voltage $V_{dd}$ are provided, and during operation, by dividing the power source voltage $V_{dd}$ with the dividing ratio which is determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the low threshold voltage nMOS transistors MLn1 and MLn2, in the high range of the power source voltage $V_{dd}$, the rapid increase of the currents in the transistors can be avoided, the stabilized reference voltage in a wide range of the power source voltage can be supplied, and the increase of the power consumption can be suppressed in the high range of the power source voltage.

Fifth Embodiment

Figure 12:
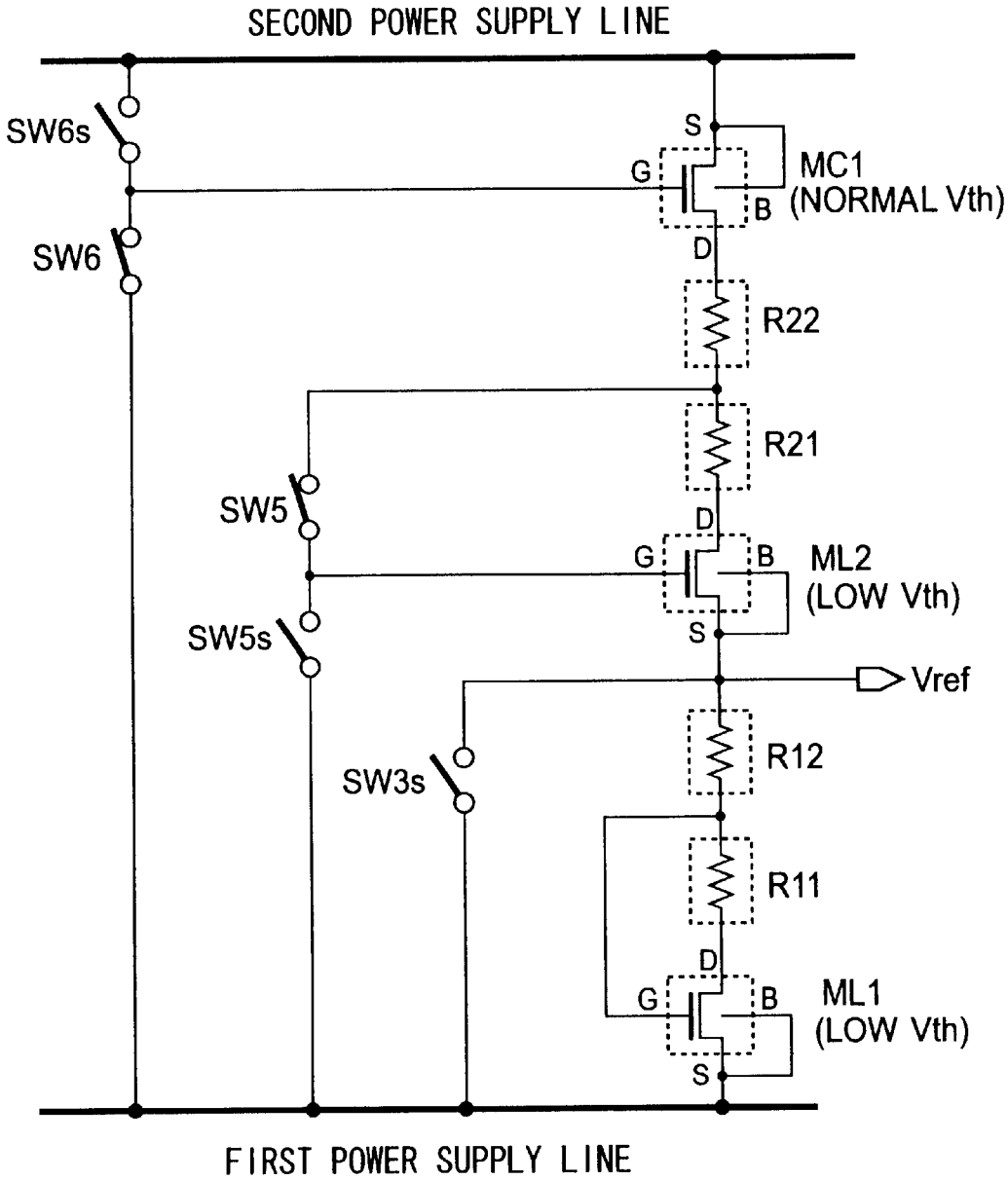
FIG. 12 is an example of a configuration showing a fifth embodiment of the reference voltage generator according to the present invention.

FIG. 12 is a configuration diagram showing a fifth embodiment of the reference voltage generator of the present invention.

As shown in this diagram, the reference voltage generator of this embodiment is constituted by a MOS transistor MC1, transistors ML1, ML2 having a conductivity type different from the MOS transistor MC1, resistance elements R11, R12, R21, R22, and switching elements SW3*s*, SW5, SW5*s*, 5W6, SW6*s*.

The transistor MC1 is a transistor having a normal threshold voltage, while the transistors ML1, ML2 are low threshold voltage transistors having threshold voltages that are lower than a normal one. In the reference voltage generator of the present embodiment, since the lowest operational power source voltage is determined by the threshold voltages of the transistors ML1 and ML2, the range of the operational power source voltage can be widened by using the low threshold voltage transistors ML1 and ML2.

The transistor MC1, resistance elements R22, R21, the transistor ML2, resistance elements R12, R11 and the transistor ML1, are connected in series as expressed between the second power supply line and the first power supply line. The gate of the transistor ML1 is connected to the connection point of the resistance elements R11 and R12. The output terminal $T_{out}$ is formed by the connection point of the source of the transistor ML2 and the resistance element R12.

The switching element SW3*s* is provided between the output terminal of the voltage $V_{ref}$ and the first power supply line. The voltage supplied to the gate of the transistor ML2 is controlled by switching elements SW5 and SW5*s*, and furthermore the voltage supplied to the gate of the transistor MC1 is controlled by the switching elements SW6 and SW6*s*.

During operation, the switching elements SW5 and SW6 are rendered ON, and the switching elements SW3*s*, SW5*s* and 5W6*s* are rendered OFF. Namely, when in operation, the electric potential of the first power supply line is supplied to the gate of the transistor MC1, and the gate of the transistor ML2 is connected to the connection point of the resistance elements R21 and R22. Accordingly, the transistors MC1, ML1 and ML2 are held in the conductive state during operation.

During standby, the switching elements SW5 and SW6 are rendered OFF, and the switching elements SW3*s*, SW5*s* and 5W6*s* are rendered ON. Accordingly, the electric potential of the second power supply line is supplied to the gate of the transistor MC1, the electric potential of the first power source is supplied to the gate of the transistor ML2. Therefore, both of the transistors MC1 and ML2 are held in the nonconductive state. Also, the output voltage $V_{ref}$ is held in the electric potential of the first power supply line by the switching element SW3*s*. That is, the transistors MC1 and ML2 are held in the nonconductive state and the output voltage $V_{ref}$ is held in the electric potential of the first power supply line during standby.

Figure 13:
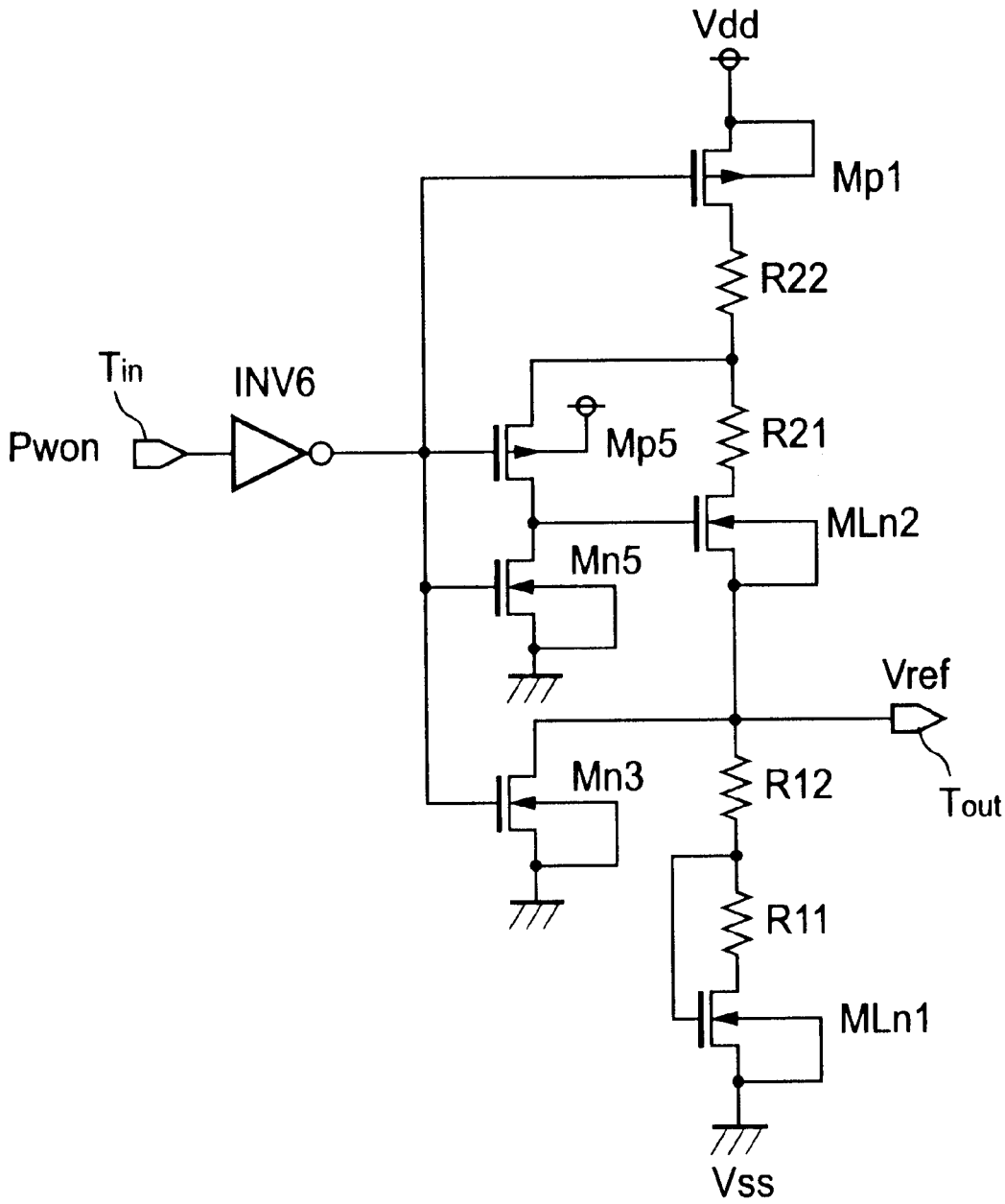
FIG. 13 is a circuit diagram showing the fifth embodiment of the reference voltage generator according to the present invention.

FIG. 13 is a circuit diagram showing a concrete circuit configuration of the reference voltage generator of the present embodiment.

As shown in this diagram, the reference voltage generator of the present embodiment is constituted by a pMOS transistor Mp1, resistance elements R22, R21, an nMOS transistor MLn2, resistance elements R12, R11, nMOS transistors MLn1, Mn3, Mn5, a PMOS transistor Mp5, and an inverter INV6 connected in series between the supply line of the power source voltage $V_{dd}$ and the common potential line.

The pMOS transistor Mp1 is a transistor having a normal threshold voltage, while the nMOS transistors MLn1 and MLn2 are the low threshold voltage transistors having threshold voltages that are lower than a normal one. Accordingly, the range of the power source voltage that is operational becomes wider by using the low threshold voltage transistors MLn1 and MLn2 in the reference voltage generator of the present embodiment.

The source of the transistor Mp1 is connected to the supply line of the power source voltage $V_{dd}$ and the drain thereof is connected to the resistance element R22. The drain of the transistor MLn2 is connected to the resistance element R21, and the source thereof is connected to the resistance element R12. The drain of the transistor MLn1 is connected to the resistance element R11, and the source is connected to the common potential line. The gate of the transistor MLn1 is connected to the connection point of the resistance elements R12 and R11. The output terminal $T_{out}$ is formed by the connection point of the source of the transistor MLn2 and the resistance element R12. The power source voltage $V_{dd}$ is supplied to the channel forming region of the transistor Mp1, the output voltage $V_{ref}$ is supplied to the channel forming region of the transistor MLn2, and the common potential $V_{SS}$ is supplied to the channel forming region of the transistor MLn1.

The input terminal of the inverter INV6 is connected to the input terminal $T_{in}$, the output terminal thereof is connected to the gates of the transistors Mp1, Mn3, Mn5, and Mp5. The source of the transistor Mp5 is connected to the connection point of the resistance element R22 and the resistance element R21, the drain thereof is connected to the gate of the transistor MLn2. The drain of the transistor Mn5, along with the drain of the transistor Mp5, is connected to the gate of the transistor MLn2, the source thereof is connected to the common potential line. Moreover, the drain of the transistor Mn3 is connected to the output terminal $T_{out}$, and the source thereof is connected to the common potential line.

A power-on signal $P_{won}$ is inputted to the input terminal $T_{in}$. The power-on signal $P_{won}$ is held in the high level during operation and held in the low level during standby.

Below, an explanation will be made of an operation of the reference voltage generator of the present embodiment by referring to FIG. 13.

During operation, since the power-on signal $P_{won}$ is held in the high level, the output terminal of the inverter INV6 is held in the low level. In response to this, the pMOS transistors Mp1 and Mp5 are in the conductive state. Therefore, the gate of the nMOS transistor MLn2 is connected to the connection point of the resistance elements R22 and R21. Namely, when in operation, the transistor Mp1 is in the conductive state, and since voltages higher than each drain voltage are supplied to the gates of the transistors MLn1 and MLn2, the transistors MLn1 and MLn2 are in the conductive state. At this time, the voltage $V_{ref}$ of the output terminal $T_{out}$ is set by the dividing ratio determined by the ON resistances of these transistors and the resistance values of the resistance elements R22, R21, R12 and R11. The output voltage of the output terminal $T_{out}$ can be controlled at the intermediate voltage $V_{dd}/2$ of the power supply voltage $V_{dd}$ by appropriately setting the ON resistances of the transistors and the resistance values of the resistance elements R22, R21, R12 and R11.

During standby, since the power-on signal $P_{won}$ is held in the low level, the output terminal of the inverter INV6 is held in the high level. In response to this, the pMOS transistors Mp1 and Mp5 are held in the nonconductive state, while the nMOS transistors Mn3 and Mn5 are held in the conductive state. Therefore, the gate of the NMOS transistor MLn2 and the output terminal $T_{out}$ are held at the common potential $V_{SS}$.

Accordingly, during standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the sum of the resistance values of the resistance elements R22 and R21 or the sum of the resistance values of the resistance elements R12 and R11, are adequately smaller than the ON resistance values of the MOS transistors MLn1 and MLn2, and therefore the currents in the transistors MLn1 and MLn2 are practically determined by the ON resistances of these transistors.

On the other hand, when operating in the high range of the power source voltage, the ON resistances of the transistors MLn1 and MLn2 decline. Since the sum of the resistance values of the resistance elements R22 and R21 or the sum of the resistance values of the resistance elements R12 and R11 is set to a value approximately the same level as or higher than the ON resistance value of the transistor MLn1 and MLn2, the currents in the transistors MLn1 and MLn2 in the high range of the power source voltage is determined by the resistance elements R22, R21, R11 and R11, whereby the rapid increase of the currents can be suppressed when operating in the high range of the power source voltage.

As explained above, according to the present embodiment, the pMOS transistor Mp1, the resistance elements R22, R21, the nMOS transistor MLn2, the resistance elements R12, R11, and the nMOS transistor MLn1 connected in series between the supply line of the power source voltage $V_{dd}$ and the common potential line are provided, and during operation, by dividing the power source voltage $V_{dd}$ with the dividing ratio determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the low threshold voltage nMOS transistor MLn1, MLn2, in the high range of the power source voltage $V_{dd}$, the rapid increase of the currents in the transistors can be avoided, a stabilized reference voltage in a wide range of the power source voltage can be supplied, and the increase of the power consumption can be suppressed in the high range of the power source voltage.

Sixth Embodiment

Figure 14:
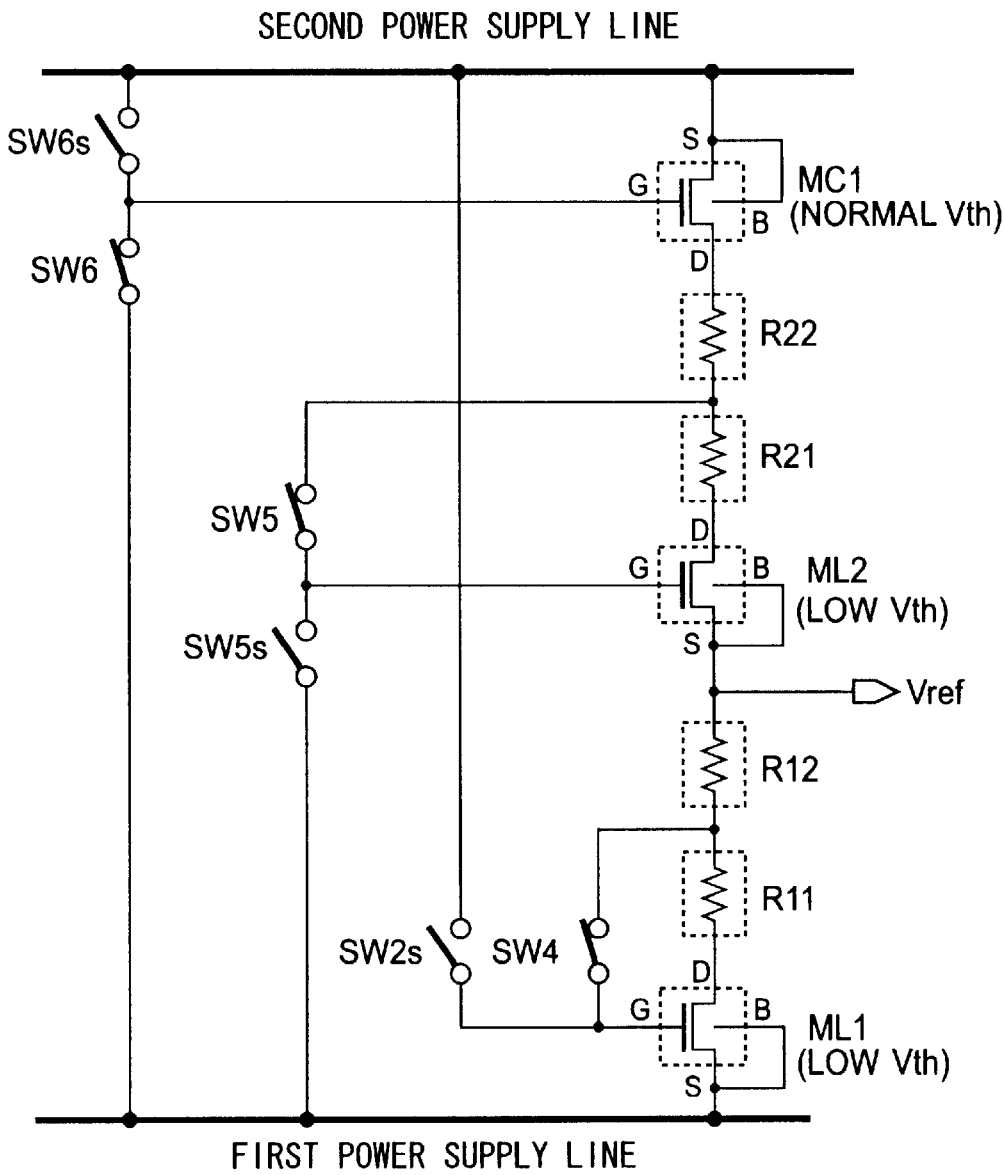
FIG. 14 is an example of a configuration showing a sixth embodiment of the reference voltage generator according to the present invention.

FIG. 14 is a configuration diagram showing a sixth embodiment of the reference voltage generator of the present invention.

As shown in this diagram, the reference voltage generator of the present embodiment is constituted by a MOS transistor MC1, transistors ML1, ML2 having a conductivity type different from the MOS transistor MC1, resistance elements R11, R12, R21, R22 and switching elements SW2*s*, SW4, SW5, SW5*s*, 5W6, SW6*s*.

The transistor MC1 is a transistor having a normal threshold voltage, while the transistors ML1 and ML2 are the low threshold voltage transistors having threshold voltages that are lower than a normal one. Note that in the reference voltage generator of the present embodiment, since the lowest operational power source voltage is determined by the threshold voltages of the transistors ML1 and ML2, the range of the operational power source voltage can be widened by using the low threshold voltage transistors ML1 and ML2.

The transistor MC1, resistance elements R22, R21, the transistor ML2, the resistance elements R12, R11 and the transistor ML1 are connected in series as expressed between the second power supply line and the first power supply line. The output terminal $T_{out}$ is formed by the connection point of the source of the transistor ML2 and the resistance element R12.

The switching element SW4 is connected between the gate of the transistor ML1 and the connection point of the resistance elements R12 and R11. The voltage supplied to the gate of the transistor ML1 is controlled by the switching elements SW2*s* and SW4, the voltage supplied to the gate of the transistor ML2 is controlled by the switching elements SW5 and SW5*s*, and the voltage supplied to the gate of the transistor MC1 is controlled by the switching elements SW6 and SW6*s*.

During operation, the switching elements SW4, SW5 and SW6 are rendered ON and the switching elements SW2*s*, SW5*s* and 5W6*s* are rendered OFF. Namely, during operation, the electric potential of the first power supply line is supplied to the gate of the transistor MC1, the gate of the transistor ML2 is connected to the connection point of the resistance elements R21 and R22, and the gate of the transistor ML1 is connected to the connection point of the resistance elements R11 and R12. Accordingly, the transistors $MC_1$, ML1 and ML2 are held in the conductive state during operation.

During standby, the switching elements SW4, SW5 and SW6 are rendered OFF and the switching elements SW2*s*, SW5*s* and 5W6*s* are rendered ON. Accordingly, during standby, the electric potential of the second power supply line is supplied to the gate of the transistor MC1, the electric potential of the first power supply line is supplied to the gate of the transistor ML2, and the electric potential of the second power supply line is supplied to the gate of the transistor ML1. Therefore, both of the transistors MC1 and ML2 are held in the nonconductive state and the transistor ML1 is held in the conductive state. Accordingly, the output voltage $V_{ref}$ is held in the electric potential of the first power supply line.

Figure 15:
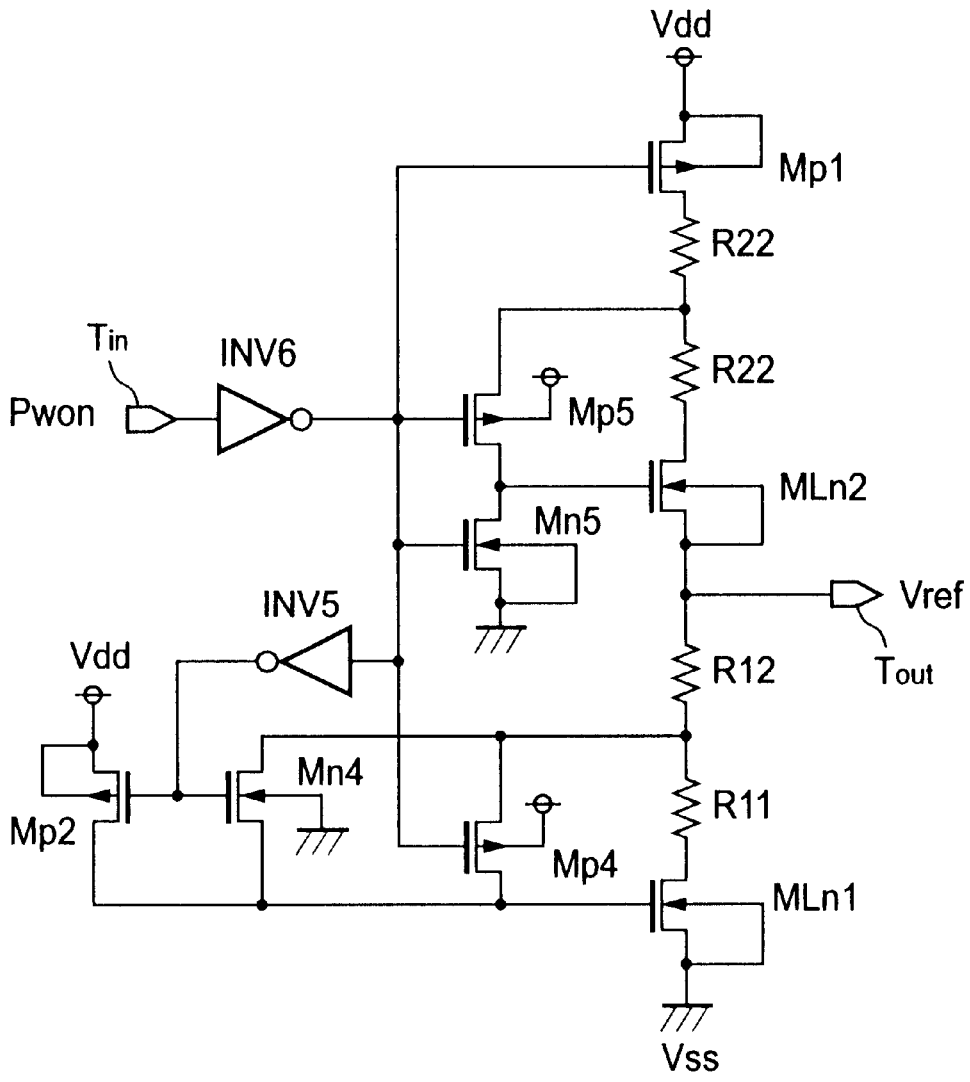
FIG. 15 is a circuit diagram showing the sixth embodiment of the reference voltage generator according to the present invention.

FIG. 15 is a circuit diagram showing a concrete circuit configuration of the reference voltage generator of the present embodiment.

As shown in this diagram, the reference voltage generator of the present embodiment is constituted by a pMOS transistor Mp1, resistance elements R22, R21, an nMOS transistor MLn2, resistance elements R12, R11, an nMOS transistor MLn1, pMOS transistors Mp2, Mp4, Mp5, nMOS transistors Mn4, Mn5, and inverters INV5, INV6 connected in series between the supply line of the power source voltage $V_{dd}$ and the common potential line.

The pMOS transistor Mp1 is a transistor having a normal threshold voltage, while the nMOS transistors MLn1 and MLn2 are the low threshold voltage transistors having threshold voltages that are lower than a normal one. Accordingly, the range of the power source voltage that is operational becomes wider by using the low threshold voltage transistors MLn1 and MLn2 in the reference voltage generator of this embodiment.

The source of the transistor Mp1 is connected to the supply line of the power source voltage $V_{dd}$, and the drain thereof is connected to the resistance element R22. The drain of the transistor MLn2 is connected to the resistance element R21, and the source thereof is connected to the resistance element R12. The drain of the transistor MLn1 is connected to the resistance element R11, and the source thereof is connected to the common potential line. The output terminal $T_{out}$ is formed by the connection point of the source of the transistor MLn2 and the resistance element R12.

The input terminal of the inverter INV6 is connected to the input terminal $T_{in}$, the output terminal thereof is connected to the gates of the transistors Mp1, Mp4, Mp5 and Mn5, and the input terminal of the inverter INV5. The output terminal of the inverter INV5 is connected to the gates of the transistors Mp2 and Mn4. The source of the transistor Mp2 is connected to the supply line of the power source voltage $V_{dd}$, the drain thereof is connected to the gate of the transistor MLn1, the drain of the transistor Mn4 is connected to the connection point of the resistance elements R12 and R11, the source thereof is connected to the gate of the transistor MLn1, the source of the transistor Mp4 is connected to the connection point of the resistance elements R12 and R11, and the drain thereof is connected to the gate of the transistor MLn1. Namely, the transistors Mn4 and Mp4 constitute transfer gates which are provided between the connection point of the resistance elements R12 and R11, and the gate of the transistor MLn1.

The source of the transistor Mp5 is connected to the connection point of the resistance elements R22 and R11, and the drain thereof is connected to the gate of the transistor MLn2. The drain of the transistor Mn5, along with the drain of the transistor Mp5, is connected to the gate of the transistor MLn2, and the source thereof is connected to the common potential line.

A power-on signal $P_{won}$ is inputted to the input terminal $T_{in}$. The power-on signal $P_{won}$ is held in the high level during operation, and held in the low level during standby.

Below, an explanation will be made of an operation of the reference voltage generator of the present embodiment by referring to FIG. 15.

During operation, since the power-on signal $P_{won}$ is held in the high level, the output terminal of the inverter INV6 is held in the low level while the output terminal of the inverter INV5 is held in the high level. Accordingly, the pMOS transistors Mp1, Mp4, Mp5, and the nMOS transistor Mn4 are in the conductive state. Therefore, the gate of the nMOS transistor MLn2 is connected to the connection point of the resistance elements R22 and R21, and the gate of the transistor MLn2 is connected to the connection point of the resistance element R12 and R11.

Therefore, during operation, the transistors MLn1 and MLn2 are in the conductive state since voltages higher than the drain voltage are supplied to the gates thereof in the transistor MLn2 and MLn1. At this time, the voltage $V_{ref}$ of the output terminal $T_{out}$ is set by the dividing ratio determined by the ON resistances of these transistors and the resistance values of the resistance elements R22, R21, R12 and R11. The output voltage of the output terminal $T_{out}$ can be controlled at the intermediate voltage $V_{dd}/2$ of the power supply voltage $V_{dd}$ by appropriately setting the ON resistances of the transistors and the resistance values of the resistance elements R22, R21, R12 and R11.

During standby since the power-on signal $P_{won}$ is held in the low level, the output terminal of the inverter INV6 is held in the high level while the output terminal of the inverter INV5 is held in the low level. Accordingly, the pMOS transistors Mp1, Mp4, Mp5 and the nMOS transistor Mn4 are held in the nonconductive state, while the nMOS transistor Mn5 and the pMOS transistor Mp2 are held in the conductive state. Accordingly, the power source voltage $V_{dd}$ is supplied to the gate of the transistor MLn1 and the common potential $V_{SS}$ is supplied to the gate of the nMOS transistor MLn2. Namely, during standby, both of the transistors Mp1 and MLn2 are held in the nonconductive state and the transistor MLn1 is held in the conductive state.

Like this, during standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the sum of the resistance values of the resistance elements R22 and R21 or the sum of the resistance values of the resistance elements R12 and R11, are adequately smaller than the ON resistance value of the MOS transistors MLn1 and MLn2. Thus the currents in the transistors MLn1 and MLn2 are practically determined by the ON resistances of these transistors.

On the other hand, when operating in the high range of the power source voltage, the ON resistances of the transistors MLn1 and MLn2 decline. In the high range of the power source voltage, since the sum of the resistance values of the resistance elements R22 and R21 or the sum of the resistance values of the resistance elements R12 and R11 is set to a value approximately the same level as or higher than the ON resistance value of the transistors MLn1 and MLn2, the currents in the transistors MLn1 and MLn2 in the high range of the power source voltage is determined by the resistance elements R22, R21, R11 and R11, whereby the rapid increase of the currents can be suppressed when operating in the high range power source voltage.

As explained above, according to the present embodiment, the pMOS transistor Mp1, the resistance elements R22, R21, the nMOS transistor MLn2, the resistance elements R12, R11, the nMOS transistor MLn1 connected in series between the supply line of the power source voltage $V_{dd}$ and the common potential line are provided, and during operation, by dividing the power source voltage $V_{dd}$ with the dividing ratio determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the low threshold voltage nMOS transistors MLn1 and MLn2, in the high range of the power source voltage $V_{dd}$, the rapid increase of the currents in the transistors can be avoided, a stabilized reference voltage in a wide range of the power source voltage can be supplied, and the increase of the power consumption can be suppressed in the high range of the power source voltage.

Seventh Embodiment

Figure 16:
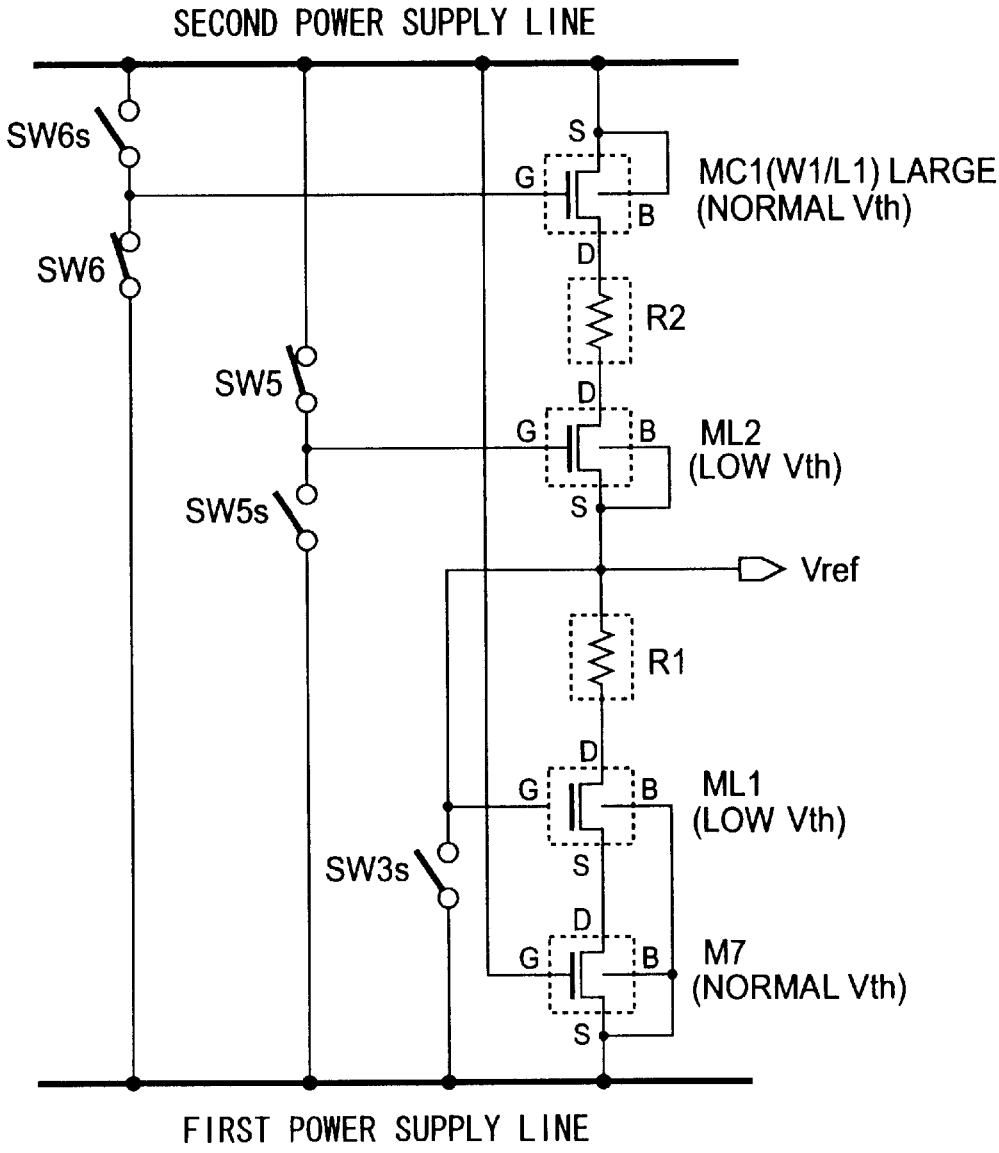
FIG. 16 is an example of a configuration showing a seventh embodiment of the reference voltage generator according to the present invention.

FIG. 16 is a configuration diagram showing a seventh embodiment of the reference voltage generator of the present invention.

As shown in this diagram, the reference voltage generator of the present embodiment is constituted by a MOS transistor MC1, transistors ML1, ML2, M7 having a conductivity type different from the MOS transistor MC1, resistance elements R2, R1, and switching elements SW3*s*, SW5, SW5*s*, 5W6, SW6*s*.

The transistor MC1 is a transistor having a normal threshold voltage, while the transistors ML1 and ML2 are the low threshold voltage transistors having threshold voltages that are lower than a normal one. The transistor M7 is a transistor having a normal threshold voltage. Note that in the reference voltage generator of the present embodiment, since the lowest operational power source voltage is determined by the threshold voltages of the transistors ML1 and ML2, the range of the operational power source voltage can be widened by using low threshold voltage transistors ML1 and ML2.

The transistor MC1, the resistance element R2, the transistor ML2, the resistance element R11, the transistor ML1 and the transistor M7 are connected in series as expressed between the second power supply line and the first power supply line. The output terminal $T_{out}$ is formed by the connection point of the source of the transistor ML2 and the resistance element R1.

The switching element SW3*s* is provided between the output terminal of the output voltage $V_{ref}$ and the first power supply line. The voltage supplied to the gate of the transistor ML2 is controlled by the switching elements SW5 and SW5*s*, the voltage supplied to the gate of the transistor MC1 is controlled by the switching elements SW6 and SW6*s*, and the voltage supplied to the gate of the transistor MC1 is controlled by the switching elements SW6 and SW6*s*. The voltage of the second power supply line is supplied to the gate of the transistor M7.

During operation, the switching elements SW5 and SW6 are rendered ON, and the switching elements SW3*s*, SW5*s* and 5W6*s* are rendered OFF. Namely, the electric potential of the first power supply line is supplied to the gate of the transistor MC1, and the electric potential of the second power supply line is supplied to the gate of the transistor ML2 during operation. Furthermore, during operation, the transistors MC1, ML1, ML2, and Mn7 are held in the conductive state since the output voltage $V_{ref}$ is supplied to the gate of the transistor ML1.

During standby, the switching element SW5 and SW6 are rendered OFF and the switching elements SW3*s*, SW5*s* and 5W6*s* are rendered ON. Accordingly, during standby, the electric potential of the second power supply line is supplied to the gate of the transistor MC1, and the electric potential of the first power source is supplied to the gate of the transistor ML2. Therefore, both of the transistors MC1 and ML2 are held in the nonconductive state. Further, the output voltage $V_{ref}$ is held in the electric potential of the first power supply line by the switching element SW3*s*. Namely, the transistors MC1 and ML2 are held in the nonconductive state, and the output voltage $V_{ref}$ is held in the electric potential of the first power supply line during standby.

Figure 17:
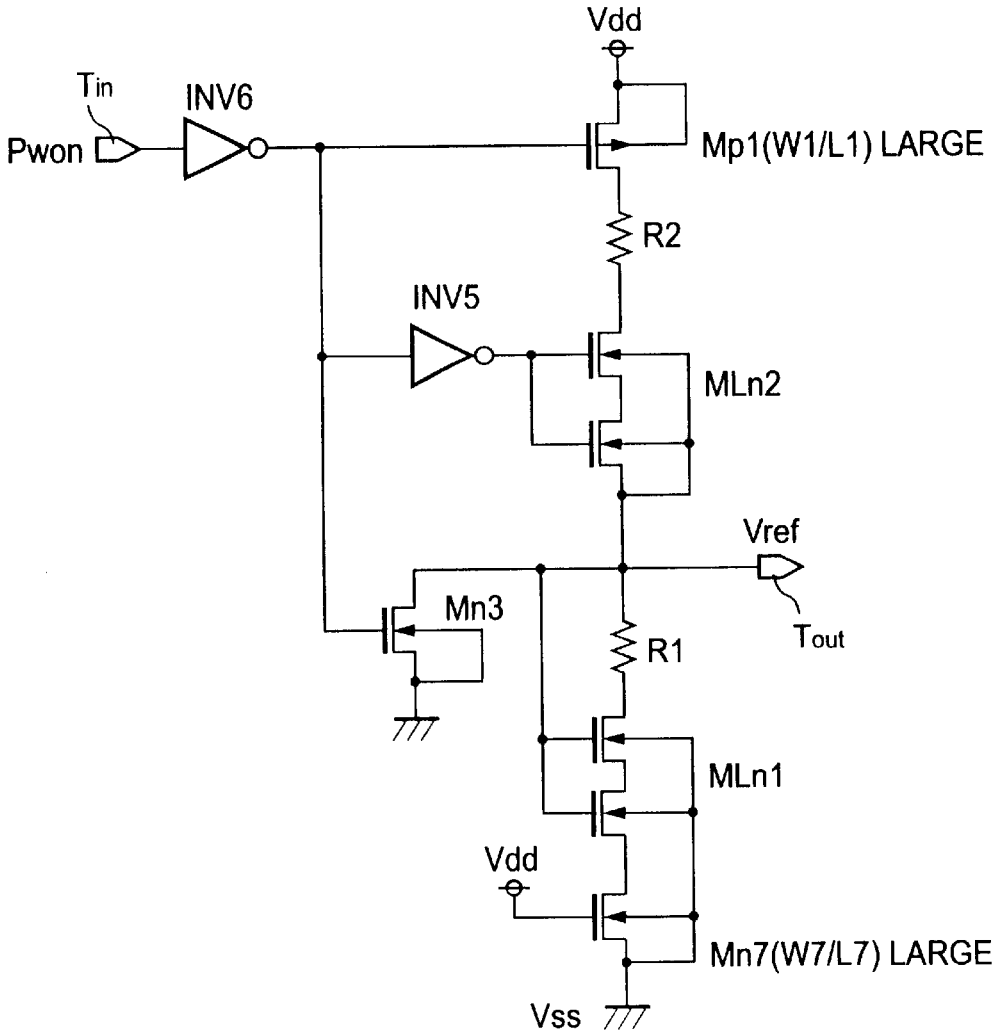
FIG. 17 is a circuit diagram showing the seventh embodiment of the reference voltage generator according to the present invention.

FIG. 17 is a circuit diagram showing a concrete circuit configuration of the reference voltage generator of the present embodiment.

As shown in this diagram, the reference voltage generator of the this embodiment is constituted by a pMOS transistor Mp1, a resistance element R2, an nMOS transistor MLn2, a resistance element R1, nMOS transistors MLn1, Mn7, Mn3, and inverters INV5, INV6 connected in series between the supply line of the power source voltage $V_{dd}$ and the common potential line.

The pMOS transistor Mp1 and the nMOS transistor Mn7 are transistors having normal threshold voltages, while the nMOS transistors MLn1 and MLn2 are the low threshold voltage transistors having threshold voltages that are lower than a normal one. In the reference voltage generator of the present embodiment, the range of the power source voltage that is operational becomes wider by using the low threshold voltages MLn1 and MLn2.

The source of the transistor Mp1 is connected to the supply line of the power source voltage $V_{dd}$, and the drain thereof is connected to the resistance element R2. The drain of the transistor MLn2 is connected to the resistance element R2, and the source thereof is connected to the resistance element R1. The drain of the transistor MLn1 is connected to the resistance element R1, the source thereof is connected to the drain of the transistor Mn7. The source of the transistor Mn7 is connected to the common potential line. Furthermore, the gate of the transistor Mn7 is connected to the supply line of the power source voltage $V_{dd}$. The output terminal $T_{out}$ is formed by the connection point of the source of the transistor MLn2 and the resistance element R1.

The input terminal of the inverter INV6 is connected to the input terminal $T_{in}$, the output terminal thereof is connected to the gates of the transistor Mp1, the input terminal of the inverter INV5 and the gate of the transistor Mn3. The output terminal of the INV5 is connected to the gate of the transistor MLn2. The drain of the transistor Mn3, along with the gate of the transistor MLn1, is connected to the output terminal $T_{out}$.

A power-on signal $P_{won}$ is inputted to the input terminal $T_{in}$. The power-on signal $P_{won}$ is held in the high level during operation, and held in the low level during standby.

As shown in FIG. 17, in the reference voltage generator of the present embodiment, the transistors MLn1 and MLn2 are respectively constituted by two nMOS transistors connected in series. For example, the transistor MLn2 is constituted by two nMOS transistors connected in series between the resistance element R2 and the output terminal $T_{out}$. The gates of these transistors are connected to the output terminal of the inverter INV5, and both channel forming regions thereof are connected to the output terminal $T_{out}$. Similarly, the transistor MLn1 is constituted by two nMOS transistors connected in series between the resistance element R1 and the transistor Mn7. The gates of these transistors are connected to the output terminal $T_{out}$, and both channel forming regions thereof are connected to the common potential line.

In the reference voltage generator of the present embodiment, the low threshold voltage transistors MLn1 and MLn2 are constituted by a plurality of transistors connected in series with equal bulk bias voltages, respectively. Accordingly, fluctuation of the ON resistances of the transistors can be made smaller, and the repression of the power consumption in the high range of the power source voltage and the improvement of the stability of the operation can be achieved.

Below, an explanation will be made of an operation of the reference voltage generator of the present embodiment by referring to FIG. 17.

During operation, since the power-on signal $P_{won}$ is held in the high level, the output terminal of the inverter INV6 is held in the low level while the output terminal of the inverter INV5 is held in the high level. Accordingly, the PMOS transistor Mp1 and nMOS transistor MLn2 are in the conductive state. Furthermore, since the output voltage $V_{ref}$ is supplied to the gate of the nMOS transistor MLn1, the transistor MLn1 is in the conductive state and the transistor Mn3 is in the nonconductive state. Namely, the transistors Mp1, MLn2, MLn1, and Mn7 are in the conductive state during operation. At this time, the voltage $V_{ref}$ of the output terminal $T_{out}$ is set by the dividing ratio determined by the ON resistances of these transistors and the resistance values of the resistance elements R1 and R2. Hence the output voltage of the output terminal $T_{out}$ can be controlled at the intermediate voltage $V_{dd}/2$ of the power supply voltage $V_{dd}$ by appropriately setting the ON resistances of the transistors and the resistance values of the resistance elements R1 and R2.

During standby, since the power-on signal $P_{won}$ is held in the low level, the output terminal of the inverter INV6 is held in the high level while the output terminal of the inverter INV5 is held in the low level. Accordingly, the pMOS transistor Mp1 and the nMOS transistor MLn2 are held in the nonconductive state. Further, since the Mn3 is held in the conductive state, the output terminal $T_{out}$ is held at the common potential $V_{SS}$. Accordingly, the transistor MLn1 is also held in the nonconductive state since the gate of the nMOS transistor MLn1 is held at the common potential $V_{SS}$.

During standby, since the output voltage $V_{ref}$ is held at the common potential $V_{SS}$, and both of the transistors Mp1 and MLn2 are held in the nonconductive state, the current path between the supply line of the power source voltage $V_{dd}$ and the supply line of the common potential $V_{SS}$ is cut off, whereby the power consumption is suppressed.

In the reference voltage generator of the present embodiment, when operating in the low range of the power source voltage, the resistance values of the resistance elements R1 and R2 are adequately smaller than the ON resistance values of the MOS transistors MLn1 and MLn2. Thus the currents in the transistor MLn1 and MLn2 are practically determined by the ON resistances of these transistors.

On the other hand, the ON resistance of the transistors MLn1 and MLn2 decline when operating in the high range of the power source voltage. In the high range of the power source voltage, since the resistance values of the resistance elements R1 and R2 are set to a value approximately the same level as or higher than the ON resistance value of the transistors MLn1 and MLn2, the currents in the transistors MLn1 and MLn2 in the high range of the power source voltage are set by the resistance elements R1 and R2, whereby the rapid increase of currents can be suppressed when operating in the high range of the power source voltage.

As explained above, according to the present embodiment, the PMOS transistor Mp1, the resistance element R2, the nMOS transistor MLn2, the resistance element R1, the nMOS transistors MLn1 and Mn7 connected in series between the supply line of the power source voltage $V_{dd}$ and the common potential line are provided, and during operation, by dividing the power source voltage $V_{dd}$ with the dividing ratio determined by the ON resistances of the transistors and the resistance values of the resistance elements, the intermediate voltage $V_{dd}/2$ of the power source voltage $V_{dd}$ is output as the reference voltage. Therefore, in the reference voltage generator of the present embodiment, while using the low threshold voltage nMOS transistor MLn1 and MLn2, in the high range of the power source voltage $V_{dd}$, the rapid increase of the currents in the transistors can be avoided, a stabilized reference voltage in a wide range of the power source voltage can be supplied, and the increase of the power consumption can be suppressed in the high range of the power source voltage.

Eighth Embodiment

Figure 18:
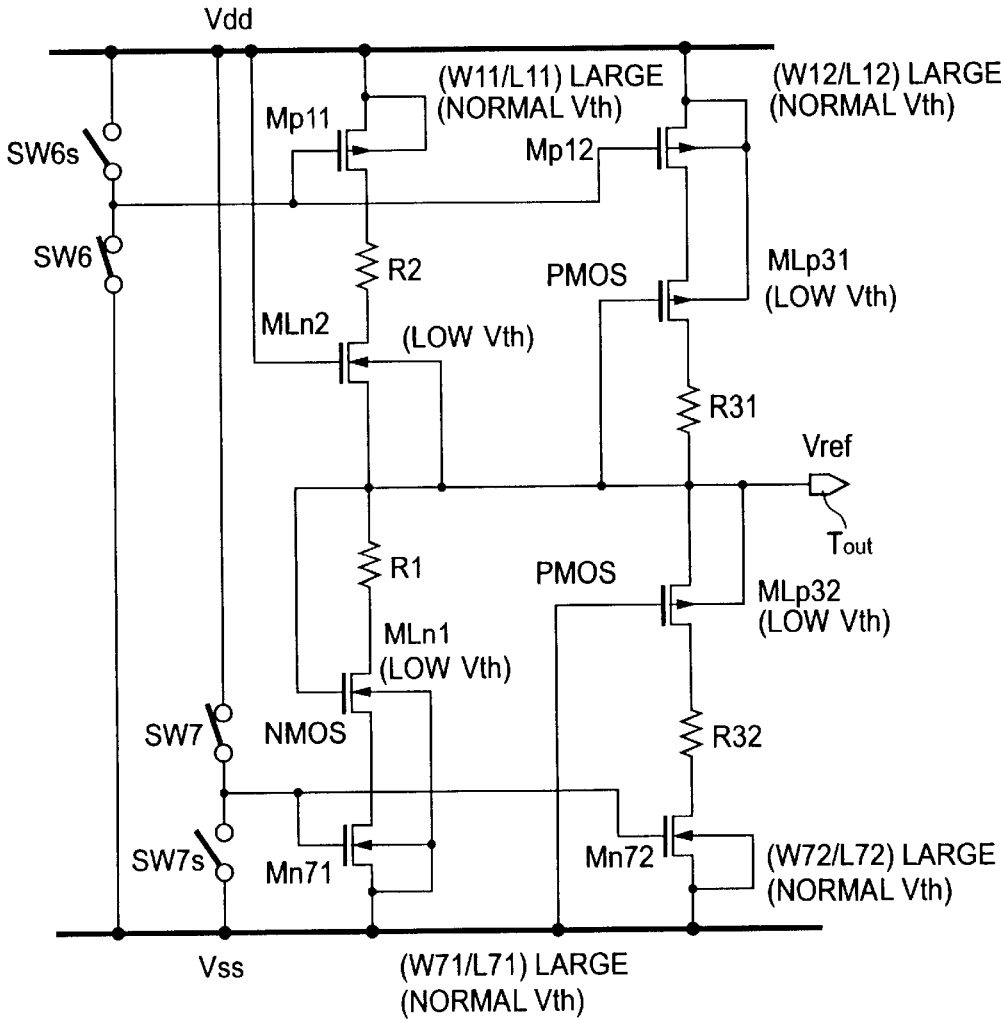
FIG. 18 is a first example of a configuration showing an eighth embodiment of the reference voltage generator according to the present invention.
Figure 19:
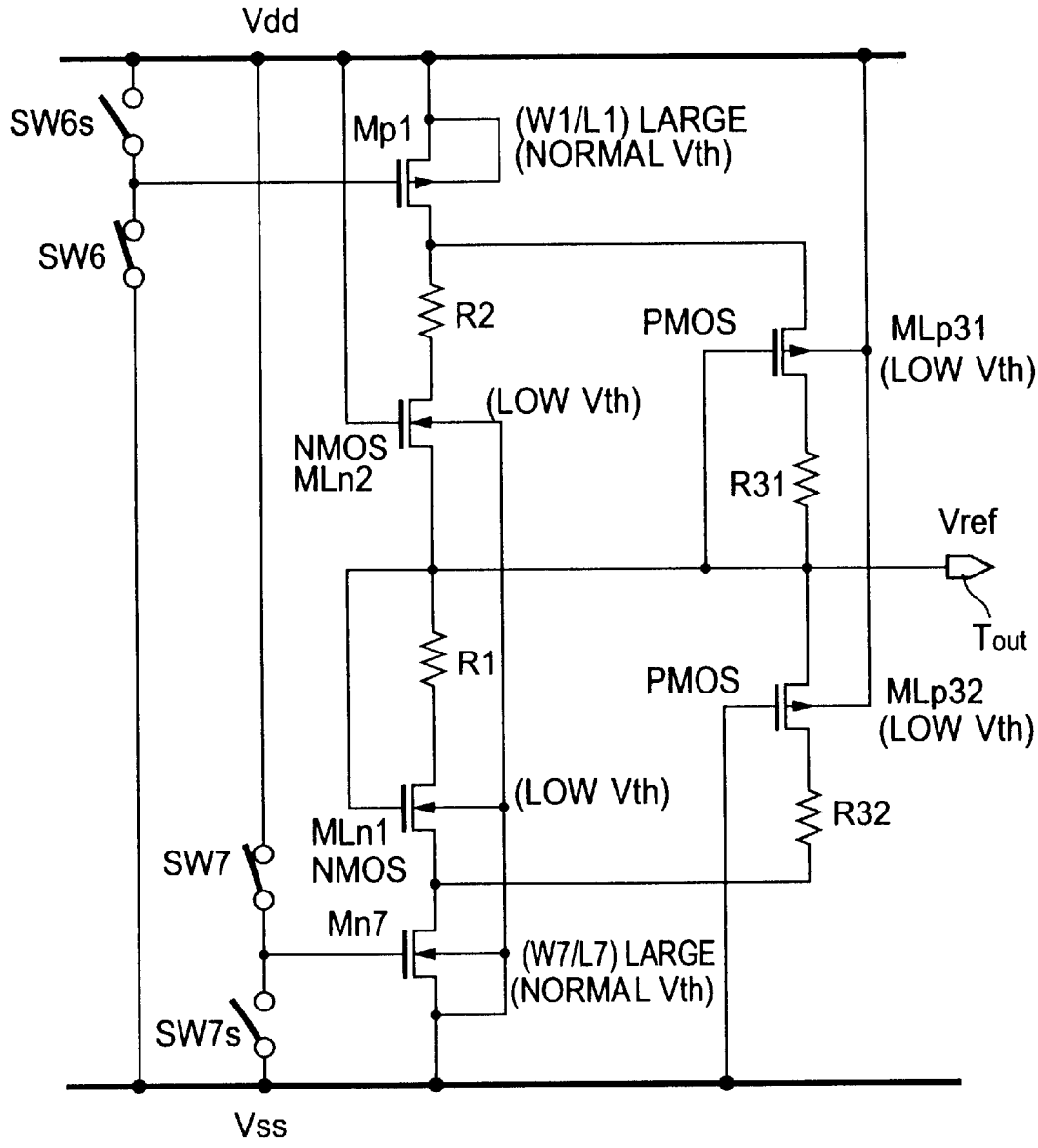
FIG. 19 is a second example of a configuration showing the eighth embodiment of the reference voltage generator according to the present invention.

FIGS. 18 and 19 are configuration diagrams showing an eighth embodiment of the reference voltage generator of the present invention.

As shown in this diagram, the reference voltage generator of the present embodiment generates a reference voltage by using two circuits constituted by MOS transistors and resistance elements connected in series.

Below, an explanation will be made of the respective configurations and operations by referring to FIG. 18 and FIG. 19.

As shown in FIG. 18, the reference voltage generator is constituted by pMOS transistors Mp11, Mp12, MLp31, MLp32, nMOS transistors MLn1, MLn2, Mn71, Mn72, resistance elements R1, R2 and R31, R32, and switching elements SW6, SW6*s*, SW7, SW7*s*.

The transistors Mp11, Mp12, Mn71 and Mn72 are the transistors having normal threshold voltages, and the transistors MLn1, MLn2, MLp31 and MLp32 are the low threshold voltage transistors having lower threshold voltages than a normal one.

Note that in the reference voltage generator of the present embodiment, since the lowest operational power source voltage is determined by the threshold voltages of the transistors MLn1, MLn2, MLp31 and MLp32, the range of the operational power source voltage can be widened by using the low threshold voltage transistors MLn1, MLn2, MLp31 and MLp32.

The transistor Mp11, the resistance element R2, the transistor MLn2, the resistance element R11, the transistor MLn1 and the transistor Mn71 are connected in series as expressed between the supply line of the power source voltage $V_{dd}$ and the common potential line. The output terminal $T_{out}$ is formed by the connection point of the source of the transistor MLn2 and the resistance element R1. The output voltage $V_{ref}$ is supplied to the channel forming region of the transistor MLn2, and the common potential $V_{SS}$ is supplied to the channel forming regions of the transistors MLn1 and Mn7*l*.

The transistors Mp12, MLp31, the resistance element R31, the transistor MLn32, the resistance element R32, and the transistor Mn72 are connected in series as expressed between the supply line of the power source voltage $V_{dd}$ and the common potential line. The output terminal $T_{out}$ is formed by the connection point of the source of the transistor MLp32 and the resistance element R31. The power source voltage $V_{dd}$ is supplied to the channel forming regions of the transistors Mp12 and MLp31, the output voltage $V_{ref}$ is supplied to the channel forming region of the transistor MLp32, and the common potential $V_{SS}$ is supplied to the channel forming region of the transistor Mn72.

The gates of the transistors Mp11 and Mp12 are commonly connected, the switching element SW6*s* is provided between the connection point thereof and the supply line of the power source voltage $V_{dd}$, and the switching element SW6 is provided between the connection point thereof and the common potential line.

The gates of the transistor Mn71 and Mn72 are commonly connected, the switching element SW7 is provided between the connection point thereof and the supply line of the power source voltage $V_{dd}$, the switching element SW7*s* is provided between the connection point thereof and the common potential line.

Below, an explanation will be made of an operation of the reference voltage generator shown in FIG. 18.

During operation, the switching elements SW6 and SW7 are rendered ON and the switching elements SW6*s* and SW7*s* are rendered OFF. Namely, the common potential $V_{SS}$ is supplied to the gates of the pMOS transistors Mp11 and Mp12, and the power source voltage $V_{dd}$ is supplied to the gates of the nMOS transistors Mn71 and Mn72. Furthermore, since the power source voltage $V_{dd}$ is supplied to the gate of the nMOS transistor MLn2, the output voltage $V_{ref}$ is supplied to the gate of the pMOS transistor MLp31, and the common potential $V_{SS}$ is supplied to the gate of the transistor MLp32. Therefore, all the transistors Mp11, Mp12, MLn2, MLn1, MLp31, MLp32, Mn71, and Mn72 are held in the conductive state during operation.

At this time, the output voltage $V_{ref}$ of the output terminal $T_{out}$ is set by the dividing ratio determined by the ON resistances of these transistors and the resistance values of the resistance elements R1, R2, R31 and R32. The output voltage of the output terminal $T_{out}$ can be controlled at the intermediate voltage $V_{dd}/2$ of the power source voltage $V_{dd}$ by appropriately setting the ON resistances of the transistors and the resistance values of the resistance elements.

During standby, the switching elements SW6 and SW7 are rendered OFF and the switching elements SW6*s* and SW7*s* are rendered ON. Namely, the power source voltage $V_{dd}$ is supplied to the gates of the pMOS transistors Mp11 and Mp12, and the common potential $V_{SS}$ is supplied to the gates of the nMOS transistors Mn71 and Mn72 during standby. Therefore, the transistors Mp11, Mp12, Mn71 and Mn72 are held in the nonconductive state during standby. Accordingly, during standby, the reduction of the power consumption can be achieved since the current path between the power source voltage $V_{dd}$ and the common potential $V_{SS}$ is cut off.

In the reference voltage generator of the present embodiment, when operating in the low range of the power source voltage, the ON resistances of the transistors are large. Therefore, the resistance values of the resistance elements R1 and R2 are adequately smaller than the ON resistance values of the MOS transistors MLn1 and MLn2. Thus the currents in the transistors MLn1 and MLn2 is practically determined by the ON resistances of these transistors. Further, the resistance values of the resistance elements R31 and R32 are adequately smaller than the ON resistance values of the MOS transistors MLp31 and MLp32, and therefore the currents in the transistors MLp31 and MLp32 are practically determined by the ON resistances of these transistors.

On the other hand, the ON resistances of the transistors MLn1, MLn2, MLp31 and MLp32 decrease when operating in the high range of the power source voltage. In the high range of the power source voltage, since the resistance elements R1 and R2 are set to have resistance values approximately the same level or higher than the ON resistance values of the transistors MLn1 and MLn2, and in the same way, the resistance elements R31 and R32 are set to have resistance values approximately the same level or higher than the ON resistance values of the transistors MLp31 and MLp32, the currents in the transistors MLn1 and MLn2 are determined by the resistance elements R31 and R32, and the currents in the transistor MLp31 and MLnp32 are determined by the resistance elements R1 and R2 in the high range of the power source voltage. The rapid increase of the currents can thus be suppressed when operating in the high range of the power source voltage.

Below, an explanation will made of an operation of the reference voltage generator shown in FIG. 19.

As shown in FIG. 19, the reference voltage generator of the present embodiment is constituted by pMOS transistors Mp1, MLp31, MLp32, nMOS transistors MLn1, MLn2, Mn7, resistance elements R1, R2, R31, R32, and switching elements SW6, SW6*s*, SW7, SW7*s*.

The transistors Mp1 and Mn7 are the transistors having normal threshold voltages, while the transistors MLn1, MLn2, MLp31, MLp32 are the low threshold voltage transistors having lower threshold voltages than a normal one.

Note that in the reference voltage generator of the present embodiment, since the lowest operational power source voltage is determined by the threshold voltage of the transistors MLn1, MLn2, MLp31 and MLp32, the range of the operational power source voltage can be widened by using the low threshold voltage transistors MLn1, MLn2, MLp31 and MLp32.

The transistor Mp1, the resistance element R2, the transistor MLn2, the resistance element R1, the transistor MLn1 and the transistor Mn7 are connected in series as expressed between the supply line of the power source voltage $V_{dd}$ and the common potential line. The output terminal $T_{out}$ is formed by the connection point of the source of the transistor MLn2 and the resistance element R1. The common potential $V_{SS}$ is supplied to the channel forming regions of the transistors MLn2, MLn1 and Mn7.

The transistor MLp31 and the resistance element R31 are connected in series as expressed between the connection point of the drain of the transistor Mp1 and the resistance element R2, and the output terminal $T_{out}$. The transistor MLp32 and the resistance element R32 are connected in series as expressed between the output terminal $T_{out}$ and the connection point of the source of transistor MLn1 and the drain of the transistor Mn7.

The switching element SW6*s* is provided between the gate of the transistor Mp1 and the supply line of the power source voltage $V_{dd}$, and the switching element SW6 is provided between the gate of the transistor Mp1 and the common potential line. The switching element SW7 is provided between the gate of the transistor Mn7 and the supply line of the power source voltage $V_{dd}$, and the switching element SW7*s* is provided between the gate of the transistor Mn7 and the common potential line.

The gate of the transistor MLn2 is connected to the supply line of the power source voltage $V_{dd}$, the gate of the transistor MLn1 is connected to the output terminal $T_{out}$. The gate of the transistor MLp31 is connected to the output terminal $T_{out}$ and the gate of the transistor MLp32 is connected to the common potential line.

Below, an explanation will be made of an operation of the reference voltage generator shown in FIG. 19.

During operation, the switching elements SW6 and SW7 are rendered ON and the switching elements SW6*s* and SW7*s* are rendered OFF. Namely, the common potential $V_{SS}$ is supplied to the gates of the pMOS transistor Mp1, the power source voltage $V_{dd}$ is supplied to the gate of the nMOS transistor Mn7 during operation. Furthermore, since the power source voltage $V_{dd}$ is supplied to the gate of the nMOS transistor MLn2, the output voltage $V_{ref}$ is supplied to the gate of the nMOS transistor MLn1 and the gate of the pMOS transistor MLp31, and the common potential $V_{SS}$ is supplied to the gate of the transistor MLp32. Thus all the transistors Mp1, MLn2, MLn1, MLp31, MLp32, and Mn7 are held in the conductive state during operation.

At this time, the voltage $V_{ref}$ of the output terminal $T_{out}$ is set by the dividing ratio determined by the ON resistances of these transistors and the resistance values of the resistance elements R1, R2, R31 and R32. The output voltage of the output terminal $T_{out}$ can be controlled at the intermediate voltage $V_{dd}/2$ of the power source voltage $V_{dd}$ by appropriately setting the ON resistances of the transistors and the resistance values of the resistance elements.

During standby, the switching elements SW6 and SW7 are rendered OFF, and the switching elements SW6*s* and SW7*s* are rendered ON. Namely, during standby, the power source voltage $V_{dd}$ is supplied to the gate of the pMOS transistor Mp1, while the common potential $V_{SS}$ is supplied to the gate of the NMOS transistor Mn7. Therefore, during standby, both of the transistors Mp1 and Mn7 are held in the nonconductive state. Accordingly, during standby, the reduction of the power consumption can be achieved since the current path between the power source voltage $V_{dd}$ and the common potential $V_{SS}$ is cut off.

In the reference voltage generator of the present embodiment, when operating in the low range of the power source voltage, the ON resistances of the transistors are large. Therefore, the resistance values of the resistance elements R1 and R2 are adequately smaller than the ON resistance values of the MOS transistors MLn1 and MLn2. Thus the currents in the transistors MLn1 and MLn2 are practically determined by the ON resistances of these transistors. Furthermore, the resistance values of the resistance elements R31 and R32 are adequately smaller than the ON resistance values of the MOS transistors MLp31 and MLp32. Thus the currents in the transistors MLp31 and MLp32 are practically determined by the ON resistances of these transistors.

On the other hand, when operating in the high range of the power source voltage, the ON resistances of the transistors MLn1, MLn2, MLp31 and MLp32 decrease. In the high range of the power source voltage, since the resistance elements R1 and R2 are set to have values approximately the same level or higher than the ON resistance values of the transistors MLn1 and MLn2, and in the same way, the resistance element R31 and R32 are set to have values approximately the same level or higher than the ON resistance values of the transistors MLp31 and MLp32, in the high range of the power source voltage, the currents in the transistors MLn1 and MLn2 are determined by the resistance elements R31 and R32, and the currents in the transistors MLp31 and MLnp32 are determined by the resistance elements R1 and R2. Thus the rapid increase of the currents can be suppressed when operating in the high range of the power source voltage.

As explained above, according to the reference voltage generator of the present embodiment, by using the transistors and the resistance elements connected in series between the supply line of the power source voltage $V_{dd}$ and the common potential line, and dividing with the dividing ratio determined by the ON resistance of these transistors and the resistance values of the resistance elements, the intermediate voltage $V_{dd}/2$ of the power source voltage $V_{dd}$ is output as the reference voltage. Therefore, according to the reference voltage generator of the present embodiment, although by using the transistors of the low threshold voltage in the reference voltage generator, in the high range of the power source voltage $V_{dd}$, the rapid increase of the currents in the transistors can be avoided, the stable reference voltage in the wide range of the power source voltage can be supplied, and the increase of the power consumption can be suppressed in the high range of the power source voltage.

Furthermore, by using two kinds of the transistors, that is, the pMOS transistors and the nMOS transistors as the low threshold voltage transistors, the influence due to the fluctuation of the transistors can be suppressed, the improvement of the stability of the output reference voltage and the reduction of the power consumption during standby can be achieved.

Figure 20:
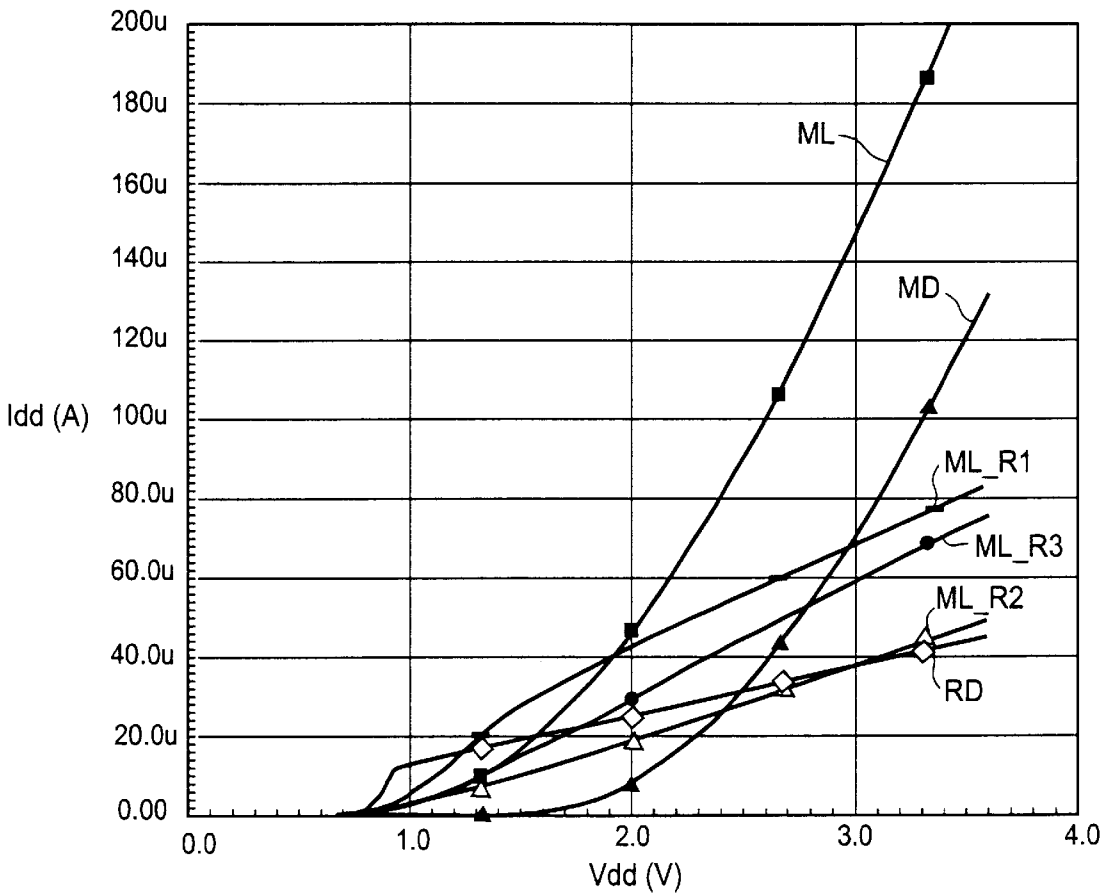
FIG. 20 is a graph showing the dependence of the power consumption and the power source voltage of the reference voltage generator.

The Dependence on the Power Source Voltage of the Current Consumption of the Reference Voltage Generator FIG. 20 is a graph showing the dependence on the power source voltage of the current consumption of the reference voltage generator of the present invention. Furthermore, for comparison, the dependence on the power source voltage of the current consumption of the reference voltage generator of a prior art is illustrated, too.

Figure 22:
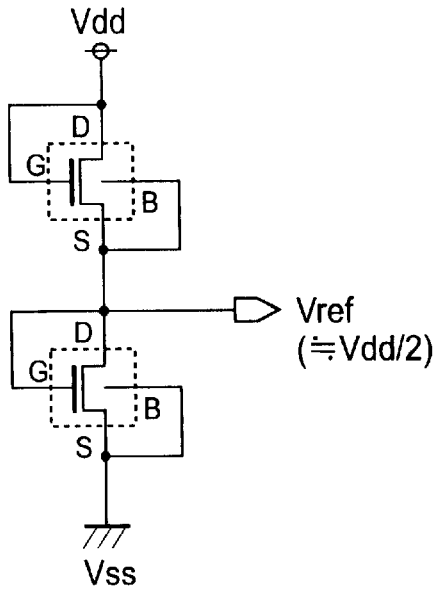
FIG. 22 is a circuit diagram showing an example of a configuration of a reference voltage generator using a diode voltage divider.
Figure 23:
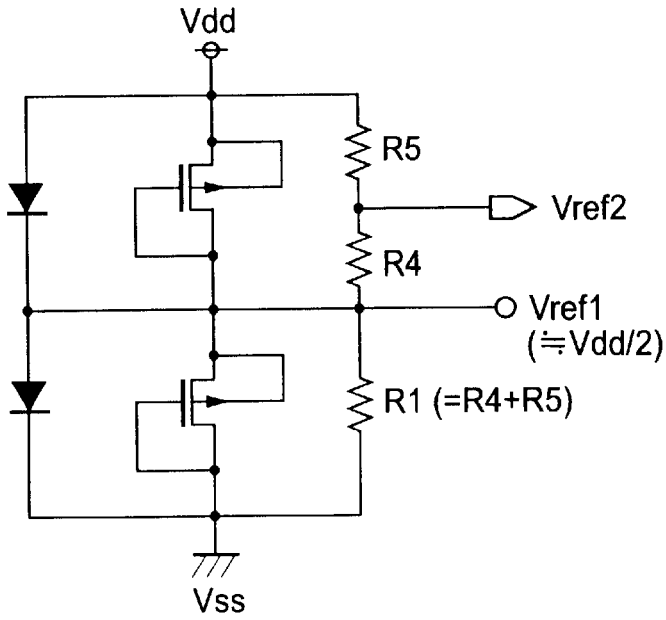
FIG. 23 is a circuit diagram showing another example of a configuration of a reference voltage generator using a diode voltage divider.
Figure 24:
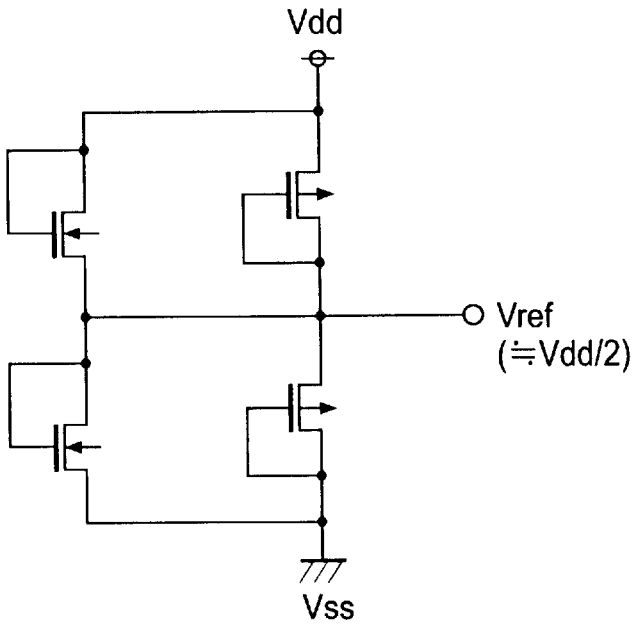
FIG. 24 is a circuit diagram showing another example of a configuration of a reference voltage generator using a diode voltage divider.

In FIG. 20, a curve MD shows the dependence on the power source voltage of the current consumption of a $V_{dd}/2$ generator formed by a voltage divider constituted by two stages of diodes connected in series as shown in FIG. 22

As illustrated, in the reference voltage generator of the prior art, since the currents in the transistors are hardly flowing when the power source voltage $V_{dd}$ is equal to or lower than 1.5V, it is difficult to supply a stable reference voltage to the load.

Further, a curve ML shows the dependence on the power source voltage of the current consumption of a $V_{dd}/2$ generator formed by a voltage divider constituted by two stages of diodes connected in series similarly as shown in FIG. 22 wherein the threshold voltages of the MOS transistors that constitute diodes are lower than normal. As illustrated, by using the transistors of the lower threshold voltages, the low range of the power source voltage, for example, when the power source voltage $V_{dd}$ is equal to 1.5V, it is possible to supply a stable intermediate voltage $V_{dd}/2$ to the load circuit since adequate currents flow in the transistors. Namely, there is no problem to operate in the low range of the power source voltage. However, there is a problem that the current consumption increases rapidly when the power source voltage rises.

Figure 25:
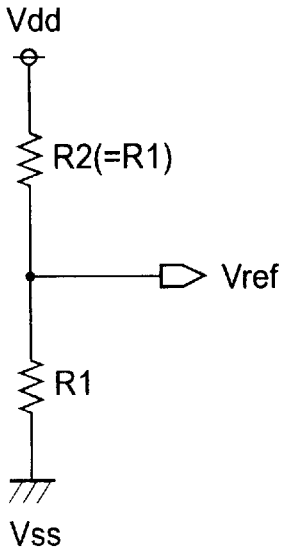
FIG. 25 is a circuit diagram showing an example of a configuration of a reference voltage generator using a resistor voltage divider.

Further, a curve RD shows the dependence on the power source voltage of the current consumption of a $V_{dd}/2$ generator formed by a resistor voltage divider constituted by two stages of diodes connected in series as shown FIG. 25.

As illustrated, in the reference voltage generator using the voltage dividing resistance elements, stable currents flow in the whole variable range of the power source voltage. However, the current consumption grows large as the power source voltage rises since the resistance values of the voltage dividing resistance elements are fixed.

In FIG. 20, curves ML_R1, ML_R2 and ML_R3 show the dependence on the power source voltage of the current consumption of the reference voltage generator of the present invention shown in FIG. 1, FIG. 2 and the FIG. 3, respectively. In the reference voltage generator of the present invention, the voltage divider is constituted by using the low threshold voltage transistors and the resistance elements connected in series to the low threshold voltage transistors to generate the intermediate voltage of $V_{dd}/2$. In the low range of the power source voltage, since the ON resistance of the transistors is large, the currents of the transistors are practically determined by the ON resistances of the transistors. While in the high range of the power source voltage, since the ON resistances of the transistors are adequately smaller in comparison with the resistance elements connected in series, the currents in the transistors are practically determined by the resistance values of the resistance elements.

Therefore, as shown in FIG. 20, the reference voltage generator of the present invention is capable of supplying a stable reference voltage even in the low range of the power source voltage $V_{dd}$ by using the low threshold voltage transistors. Further, compared with the curves MD and ML, the rapid increase of current consumption in the high range of the power source voltage $V_{dd}$ can be suppressed. Furthermore, as shown by the curves ML_R1, ML_R2 and ML_R3 shown in FIG. 20, due to the difference in the configurations of the circuits, the driving abilities in the low range of the power source voltage and the current consumptions in the high range of the power source voltage are different from each other in the reference voltage generator showing in FIG. 1, FIG. 2 and the FIG. 3, respectively, so that in the case of the reference voltage generator having priority to the driving ability at the low power source voltage, the circuit configuration showing the characteristics of the curve ML_R1 as shown in FIG. 1 is selected, while in the case of the reference voltage generator having priority to the repression of the current consumption at the high power source voltage, by selecting the circuit configuration showing the characteristics of the curve ML_R3 shown in FIG. 3, it is possible to provide the reference voltage generator which is the most suitable to each purpose.

Application Example of the Reference Voltage Generator

Figure 21:
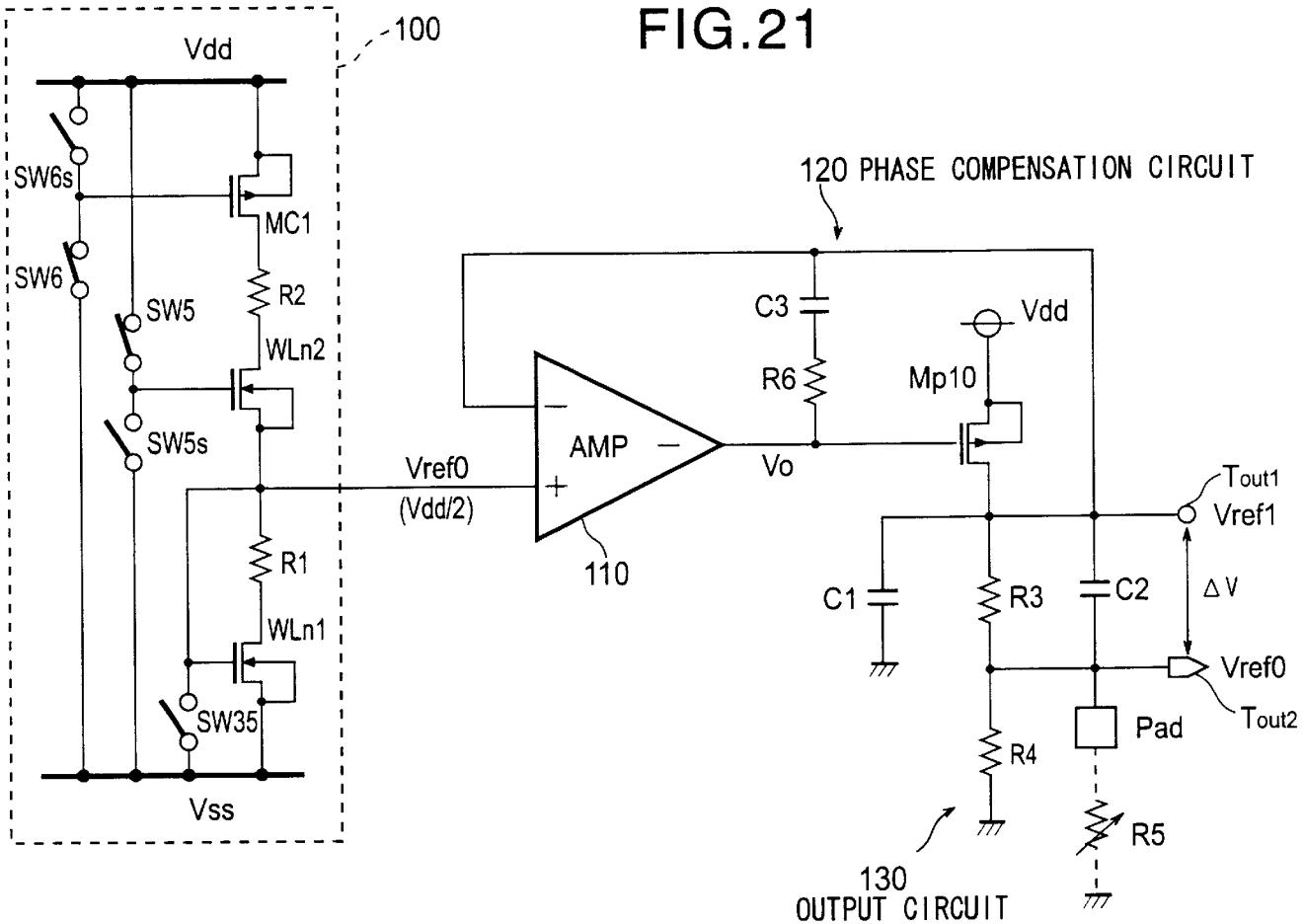
FIG. 21 is a circuit diagram showing an example of a configuration of a voltage generator using the reference voltage generator of the present invention.

FIG. 21 shows an example of the configuration of a voltage generator constituted by using the reference voltage generator of the present invention described above.

As shown in FIG. 21, the voltage generator is constituted by a reference voltage generator 100, a differential amplifier 110, a phase compensation circuit 120 and an output circuit 130. The configuration and the operation of each part will be explained in following.

The reference voltage generator 100 generates an intermediate voltage $V_{dd}/2$ of the power source voltage $V_{dd}$, and outputs this as a reference voltage $V_{ref0}$ to the differential amplifier 110.

The differential amplifier 110 receives the reference voltage $V_{ref0}$ and an output voltage $V_{ref1}$ feed back by the output circuit 130, outputs an output voltage $V_O$ corresponding to the difference of these voltages from a negative output terminal.

The compensation circuit 120 is constituted by a capacitor C3 for phase compensation and a resistance element R6 connected in series between a negative input terminal (−) of the differential amplifier 110 and an output terminal thereof.

The phase compensation circuit 120 is provided to improve the stability of the feedback control loop.

The output circuit 130 is constituted by a pMOS transistor Mp10, resistance elements R3 and R4, and capacitors C1 and C2. As shown in FIG. 21, the transistor Mp10 is connected between the supply line of the power source voltage $V_{dd}$ and the output terminal $T_{out1}$, and the gate thereof is connected to the output terminal of the differential amplifier 110. The resistance elements R3 and R4 are connected in series between the output terminal $T_{out1}$ and the common potential $V_{SS}$. The capacitor C1 is connected between the output terminal $T_{out1}$ and the common potential $V_{SS}$, and the capacitor C2 is connected between the output terminals $T_{out1}$ and $T_{out2}$. A pad "Pad" is connected to the output terminal $T_{out2}$. It is possible to connect a variable resistance element R5 between the pad "Pad" and the common potential $V_{SS}$ for voltage adjustment in response to necessity.

Note that in the circuit example shown in FIG. 21, though the reference voltage generator 100 exemplifies the reference voltage generator of the first embodiment of the present invention shown in FIG. 4, the reference voltage generator is not limited to the first embodiment, but a reference voltage generator according to any one of the embodiments 2 to 8 may be used.

Below, an explanation will be made of the operation of the voltage generator shown in FIG. 21.

By the reference voltage generator 100, the intermediate voltage $V_{dd}/2$ of the power source voltage $V_{dd}$ is generated and inputted to a positive input terminal (+) of the differential amplifier 110 as a reference voltage $V_{ref0}$. The output voltage $V_{ref1}$ of the output terminal $T_{out}$, is inputted to the negative input terminal (−) of the differential amplifier 110. Therefore, an inverse output voltage $V_O$ corresponding to the difference between the reference voltage $V_{ref0}$ and the output voltage $V_{ref1}$ is outputted from the output terminal of the differential amplifier 110.

The output voltage $V_o$ of the differential amplifier 110 is supplied to the gate of the transistor Mp10, whereby the output voltage $V_{ref1}$ is obtained from the drain of the transistor Mp10. Namely, the transistor Mp10 and the resistance elements R3 and R4 operate as an inverter of resistance load type. The output voltage $V_{ref1}$ is controlled by the level of the voltage $V_O$ supplied to the gate of the transistor Mp10.

The configuration of a general differential amplifier is constituted by the differential amplifier 110, the output circuit 130, and the phase compensation circuit 120.

In the differential amplifier 110 and the output circuit 130, the output voltage $V_{ref1}$ is controlled to approximately the same level as the reference voltage $V_{ref0}$ by the feedback control. For example, when the voltage level of the output voltage $V_{ref1}$ decreases due to some cause or other such as a change in the load, and the output voltage $V_{ref1}$ becomes lower than the reference voltage $V_{ref0}$ , a negative control voltage $V_O$ corresponding to the difference thereof is output by the differential amplifier 110 and supplied to the gate of the transistor Mp10. In response to this, the drain voltage of the transistor Mp10, that is, the level of the output voltage $V_{ref1}$ rises.

Contrarily, when the voltage level of the output voltage $V_{ref1}$ rises due to some cause or other, and the output voltage $V_{ref1}$ rises higher than the reference voltage $V_{ref0}$, a positive control voltage $V_O$ corresponding to the difference thereof is output by the differential amplifier 110 and supplied to the gate of the transistor Mp10. In response to this, the drain voltage of the transistor Mp10, that is, the level of the output voltage $V_{ref1}$ decreases.

According to the feedback control described above, the voltage $V_{ref1}$ of the level which is always approximately the same as that of the reference voltage $V_{ref0}$ is outputted from the output circuit 130. Furthermore, the output voltage $V_{ref2}$ from the output terminal $T_{out2}$ is a divided voltage obtained by dividing the output voltage $V_{ref1}$ by the resistance elements R3 and R4, so that the level thereof is determined by the resistance values of the resistance elements R3 and R4. For example, when the resistance values of the resistance elements R3 and R4 are assumed to be r3 and r4, respectively, the output voltage $V_{ref2}$ from the output terminal $T_{out2}$ can be obtained by the next equation.

$$V_{ref2}=V_{dd}/2[r4/(r3+r4)] \quad (1)$$

Furthermore, a difference ΔV between the output voltages of the output terminals $T_{out1}$ and $T_{out2}$ can be obtained by the next equation.

$$\Delta V=V_{dd}/2[r3/(r3+r4)] \quad (2)$$

Note that the capacitor C1 is provided to stabilize the output voltage $V_{ref1}$, and the capacitor C2 is provided to stabilize the output voltage $V_{ref2}$. Furthermore, the phase compensation circuit 120 constituted by the capacitor C3 and the resistance element R6 connected in series is provided to prevent the feedback control loop formed by the differential amplifier 110 and the output circuit 130 from vibrating.

As shown in FIG. 21, if the need arises, by connecting the variable resistance element R5 between the pad "Pad" and the common potential and by adjusting the resistance value of the variable resistance element R5, the dividing ratio can be controlled, whereby the voltage $V_{ref2}$ of the output terminal $T_{out2}$ can be controlled to a desired voltage value. Namely, the difference voltage ΔV between the output voltages $T_{out1}$ and $T_{out2}$ can be controlled to the desired value by setting the resistance value of the resistance element appropriately.

As described above, in the voltage generator shown in FIG. 21, the intermediate voltage $V_{dd}/2$ of the power source voltage $V_{dd}$ is generated by the reference voltage generator 100 and supplied as a reference voltage $V_{ref0}$, the control voltage $V_O$ according to the difference between the output voltage $V_{ref1}$ and the reference voltage $V_{ref0}$ is output by the differential amplifier 120, and the level of the output voltage $V_{ref1}$ is controlled by the feedback loop constituted of the differential amplifier 110, the output circuit 130 and the phase compensation circuit 120. Due to the feedback control, it is possible to control the output voltage $V_{ref1}$ at the level that is always approximately the same as the reference voltage $V_{ref0}$ without being influenced by the variation of the load anymore.

According to the voltage generator of this example, it is possible to generate a pair of voltages of the reference voltage $V_{ref0}$, that is, the intermediate voltage of the power source voltage $V_{dd}$ and a voltage having a fixed difference voltage $\Delta V$ from the intermediate voltage. The difference voltage $\Delta V$, for example, can be used as a reference voltage of an output amplitude (usually at several hundreds of $mV_{p-p}/2$) of the LVDS circuit, which performs high-speed signal transmission between the portable information terminal devices. Since the power source voltage range wherein the reference voltage generator 100 may operate is wide, the voltage generator of the present embodiment can be used in a portable cellular phone operating at a power source voltage of 1.5V or even in a notebook type personal computer operating at a power source voltage of 3.3V.

As described above, according to the reference voltage generator of the present invention, it is able to lower the minimum power source voltage at which the circuit can operate stably by using the MOS transistor of the low threshold voltage.

Further, according to the present invention, by providing resistance elements connected in series to the MOS transistors of the low threshold voltage, it is able to suppress the increase of the current consumption when operating in the high range of the power source voltage, so that the reduction of the power consumption can be achieved. Furthermore, by using MOS transistors, it is possible to reduce the layout area by half in comparison to the reference voltage generator of the prior art using dividing resisters.

Furthermore, according to the reference voltage generator of the present invention, there is an advantage that a reference voltage generator capable of operating stably in a wide range of the power source voltage can be provided to analog circuits that operate at the low power source voltage such as portable information terminal devices.

What is claimed is:

1. A reference voltage generator, comprising a first MOS transistor and a first resistance element connected in series between a first power supply line and an output terminal;

a second MOS transistor having a same conductivity type as the first MOS transistor, a second resistance element, and a third MOS transistor having a different conductivity type from the first MOS transistor connected in series between the output terminal and a second power supply line, wherein the third MOS transistor has a first threshold voltage, and the first and second MOS transistors have a second threshold voltage which has a lower absolute value than that of the first threshold voltage, and an intermediate voltage of the first power line supply and the second power supply line is output from the output terminal.

2. The reference voltage generator according to claim 1, wherein a source and a channel forming region of the first MOS transistor are connected to the first power supply line, a source and a channel forming region of the second MOS transistor are connected to the output terminal, and a source and a channel forming region of the third MOS transistor are connected to the second power supply line.

3. The reference voltage generator according to claim 1, wherein a gate of the first MOS transistor is connected to the output terminal, and a voltage of the first power supply line is supplied thereto during standby, a voltage of the second power supply line is supplied to a gate of the second MOS transistor during operation, and the voltage of the first power supply line is supplied thereto during standby, and the voltage of the first power supply line is supplied to a gate of the third MOS transistor during operation, and the voltage of the second power supply line is supplied thereto during standby.

4. The reference voltage generator according to claim 1, wherein a voltage of the output terminal is supplied to the gate of the first MOS transistor during operation, and the voltage of the second power supply line is supplied thereto during standby, the voltage of the second power supply line is supplied to the gate of the second MOS transistor during operation, and the voltage of the first power supply line is supplied thereto during standby, and the voltage of the first power supply line is supplied to the gate of the third MOS transistor during operation, and the voltage of the second power supply line is supplied thereto during standby.

5. The reference voltage generator according to claim 1, wherein the gate of the first MOS transistor is connected to the drain thereof, a drain voltage of the second MOS transistor is supplied to the gate of the second MOS transistor during operation, and the voltage of the first power supply line is supplied thereto during standby, the voltage of the first power supply line is supplied to the gate of the third MOS transistor during operation, and the voltage of the second power supply line is supplied thereto during standby, and the output terminal is connected to the first power supply line during standby.

6. The reference voltage generator according to claim 1, wherein a drain voltage of the first MOS transistor is supplied to the gate thereof during operation, and the voltage of the second power supply line is supplied thereto during standby, a drain voltage of the second MOS transistor is supplied to the gate thereof during operation, and the voltage of the first power supply line is supplied thereto during standby, and the voltage of the first power supply line is supplied to the gate of the third MOS transistor during operation, and the voltage of the second power supply line is supplied thereto during standby.

7. A reference voltage generator, comprising a first MOS transistor, a first resistance element and a second resistance element connected in series between a first power supply line and an output terminal;

a second MOS transistor having a same conductivity type as the first MOS transistor, a third resistance element, a fourth resistance element, and a third MOS transistor having a different conductivity type from the first MOS transistor connected in series between the output terminal and a second power supply line;

wherein the third MOS transistor has a first threshold voltage, and the first and second MOS transistors have a second threshold voltage which has a lower absolute value than that of the first threshold voltage, and an intermediate voltage of the first power supply line and the second power supply line is output from the output terminal.

8. The reference voltage generator according to claim 7, wherein a source and a channel forming region of the first MOS transistor are connected to the first power supply line, a source and a channel forming region of the second MOS transistor are connected to the output terminal, and a source and a channel forming region of the third MOS transistor are connected to the second power supply line.

9. The reference voltage generator according to claim 7, wherein a gate of the first MOS transistor is connected to the connection point of the first resistance element and a second resistance element, a voltage of a connection point of the third resistance element and the fourth resistance element is supplied to the gate of the second MOS transistor during operation, and a voltage of the first power supply line is supplied thereto during standby, the voltage of the first power supply line is supplied to a gate of the third MOS transistor during operation, and a voltage of the second power supply line is supplied during thereto standby, and the output terminal is connected to the first power supply line during standby.

10. The reference voltage generator according to claim 7, wherein a voltage of a connection point of the first resistance element and the second resistance element is supplied to a gate of the first MOS transistor during operation, and a voltage of the second power supply line is supplied thereto during standby, a voltage of a connection point of the third resistance element and the fourth resistance element is supplied to a gate of the second MOS transistor during operation, and a voltage of the first power supply line is supplied thereto during standby, the voltage of the first power supply line is supplied to a gate of the third MOS transistor during operation, and the voltage of the second power supply line is supplied thereto during standby.

11. A reference voltage generator, comprising a first MOS transistor and a second MOS transistor having a same conductivity type, and a first resistance element connected in series between a first power supply line and an output terminal;

a third MOS transistor having a same conductivity type as the first MOS transistor, a second resistance element, and a fourth MOS transistor having a different conductivity type from the first MOS transistor connected in series between the output terminal and a second power supply line;

wherein the first and the fourth MOS transistors have first threshold voltages of approximately equivalent absolute values, and the second and the third MOS transistors have a second threshold voltage which has a lower absolute value than that of the first threshold voltage, and an intermediate voltage of the first power supply line and the second power supply line is output from the output terminal.

12. The reference voltage generator according to claim 11, wherein a source and a channel forming region of the first MOS transistor are connected to the first power supply line, a source of the second MOS transistor is connected to a drain of the first MOS transistor, and a channel forming region of the second MOS transistor is connected to the first power supply line, a source and a channel forming region of the third MOS transistor are connected to the output terminal, and a source and a channel forming region of the fourth MOS transistor are connected to the second power supply line.

13. The reference voltage generator according to claim 11, wherein a voltage of the second power supply line is supplied to a gate of the first MOS transistor, a gate of the second MOS transistor is connected to the output terminal, and the voltage of the first power supply line is supplied to the gate of the second MOS transistor during operation, a voltage of the second power supply line is supplied to a gate of the third MOS transistor during operation, and the voltage of the first power supply line is supplied thereto during standby, and the voltage of the first power supply line is supplied to a gate of the fourth MOS transistor during operation, and the voltage of the second power supply line is supplied thereto during standby.

14. A reference voltage generator, comprising a first MOS transistor of a first conductivity type, a second MOS transistor of the same first conductivity type, and a first resistance element connected in series between a first power supply line and an output terminal;

a third MOS transistor of the first conductivity type, a second resistance element, and a fourth MOS transistor of a second conductivity type different from that of the first MOS transistor connected in series between the output terminal and a second power supply line;

a fifth MOS transistor of the first conductivity type, a third resistance element, and a sixth MOS transistor of the second conductivity type connected in series between the first power supply line and the output terminal;

a fourth resistance element, a seventh MOS transistor of the second conductivity type, and an eighth MOS transistor of the second conductivity connected in series between the output terminal and the second power supply line, wherein the first, the fourth, the fifth and the eighth MOS transistors have first threshold voltages of approximately equivalent absolute values, and the second, the third, the sixth and the seventh MOS transistors have a second threshold voltage which has a lower absolute value than that of the first threshold voltage, and an intermediate voltage of the first power supply line and the second power supply line is output from the output terminal.

15. The reference voltage generator according to claim 14, wherein a voltage of the output terminal is supplied to a gate of the second MOS transistor, a voltage of the second power supply line is supplied to a gate of the third MOS transistor, a voltage of the first power supply line is supplied to a gate of the sixth MOS transistor, the voltage of the output terminal is supplied to a gate of the seventh MOS transistor.

16. The reference voltage generator according to claim 14, wherein a voltage of the second power supply line is supplied to a gate of the first and the fifth MOS transistors during operation, and a voltage of the first power supply line is supplied thereto during standby, and the voltage of the first power supply line is supplied to a gate of the fourth and the eighth MOS transistors during operation, and the voltage of the second power supply line is supplied thereto during standby.

17. A reference voltage generator, comprising a first MOS transistor of a first conductivity type, a second MOS transistor of the same first conductivity type, and a first resistance element connected in series between a first power supply line and an output terminal;

a third MOS transistor of the first conductivity type, a second resistance element, and a fourth MOS transistor of a second conductivity type different from that of the first MOS transistor connected in series between the output terminal and a second power supply line;

a third resistance element and a fifth MOS transistor of the second conductivity type connected in series between the connection point of the first MOS transistor and the second MOS transistor and the output terminal;

a fourth resistance element and a sixth MOS transistor of the second conductivity type connected in series between the output terminal and the connection point of the second resistance element and the fourth MOS transistor, wherein the first and the fourth MOS transistors have first threshold voltages of approximately equivalent absolute values, the second, the third, the fifth and the sixth MOS transistors have a second threshold voltage which has a lower absolute value than that of the first threshold voltage, and an intermediate voltage of the first power supply line and the second power supply line is output from the output terminal.

18. The reference voltage generator according to claim 17, wherein a voltage of the output terminal is supplied to a gate of the second MOS transistor, a voltage of the second power supply line is supplied to a gate of the third MOS transistor, a voltage of the first power supply line is supplied to a gate of the fifth MOS transistor, the voltage of the output terminal is supplied to a gate of the sixth MOS transistor.

19. The reference voltage generator according to claim 17, wherein a voltage of the second power supply line is supplied to a gate of the first MOS transistor during operation, and a voltage of the first power supply line is supplied thereto during standby, and the voltage of the first power supply line is supplied to a gate of the fourth MOS transistor during operation, and the voltage of the second power supply line is supplied thereto during standby.

* * * * *